US011751748B2

(12) United States Patent
Wang et al.

(10) Patent No.: US 11,751,748 B2
(45) Date of Patent: Sep. 12, 2023

(54) DETERGENT DISPENSING DEVICE AND DISH WASHER

(71) Applicant: JIANGSU LEILI MOTOR CO., LTD., Changzhou (CN)

(72) Inventors: Xiaoqiang Wang, Changzhou (CN); Kaiyong Yuan, Changzhou (CN); Liwei Yin, Changzhou (CN)

(73) Assignee: JIANGSU LEILI MOTOR CO., LTD., Changzhou (CN)

( * ) Notice: Subject to any disclaimer, the term of this patent is extended or adjusted under 35 U.S.C. 154(b) by 388 days.

(21) Appl. No.: 17/271,536

(22) PCT Filed: Aug. 27, 2019

(86) PCT No.: PCT/CN2019/102882

§ 371 (c)(1),
(2) Date: Feb. 25, 2021

(87) PCT Pub. No.: WO2020/043102

PCT Pub. Date: Mar. 5, 2020

(65) Prior Publication Data

US 2021/0393107 A1 Dec. 23, 2021

(30) Foreign Application Priority Data

Aug. 29, 2018 (CN) ..... 201810998217.4
Jan. 25, 2019 (CN) ..... 201920139239.5
Jan. 25, 2019 (CN) ..... 201920139252.0

(51) Int. Cl.
*A47L 15/44* (2006.01)

(52) U.S. Cl.
CPC ..... *A47L 15/4418* (2013.01); *A47L 15/449* (2013.01); *A47L 15/4463* (2013.01); *A47L 2401/023* (2013.01); *A47L 2501/07* (2013.01)

(58) Field of Classification Search
None
See application file for complete search history.

(56) References Cited

U.S. PATENT DOCUMENTS 6,792,637 B2 9/2004 Reichold et al.
9,970,149 B2 5/2018 Bao et al.
(Continued)

FOREIGN PATENT DOCUMENTS

CN 1612707 5/2005
CN 103898715 7/2014
(Continued)

OTHER PUBLICATIONS

International Preliminary Reporton Patentability(IPRP) issued in in Int'l Appl. No. PCT/CN2019/102882 (dated Dec. 28, 2020).
(Continued)

*Primary Examiner* — Levon J Shahinian
(74) *Attorney, Agent, or Firm* — Barnes & Thornburg LLP

(57) ABSTRACT

A detergent dispensing apparatus 3 used for a dish washer and a dish washer comprising the detergent dispensing apparatus 3. The detergent dispensing apparatus 3 comprises a liquid storage box, a liquid outlet pump 32 and a pipeline module. The liquid storage box comprises a first half housing and a second half housing, and the first half housing and the second half housing fixedly connect each other in a first direction so as to define a liquid storage cavity used for storing detergent. The liquid outlet pump 32 is configured to suction the detergent from the liquid storage cavity and dispense the detergent to the exterior of the detergent dispensing apparatus 3. The pipeline module comprises a liquid adding channel used for adding the detergent to the liquid storage cavity, a liquid inlet channel used by the liquid outlet pump 32 for extracting the detergent from the liquid storage cavity, and a liquid outlet channel used by the liquid
(Continued)

outlet pump 32 for dispensing the detergent. The second half housing defines at least a portion of a pump accommodating space that is used for accommodating the liquid outlet pump.

20 Claims, 26 Drawing Sheets

(56) References Cited

U.S. PATENT DOCUMENTS

| | | | | |
|---|---|---|---|---|
| 2007/0151584 | A1 | 7/2007 | Omachi et al. | |
| 2016/0113478 | A1 | 4/2016 | Disch et al. | |
| 2017/0167068 | A1* | 6/2017 | Bao | B01F 25/3121 |

FOREIGN PATENT DOCUMENTS

| | | |
|---|---|---|
| CN | 105246390 | 1/2016 |
| CN | 105696261 | 6/2016 |
| CN | 108742432 | 11/2018 |
| CN | 209059090 U | 7/2019 |
| WO | 2013/160281 | 10/2013 |

OTHER PUBLICATIONS

Search Report issued in Int'l Appl. No. PCT/CN2019/102882 (dated Dec. 3, 2019).

* cited by examiner

DETERGENT DISPENSING DEVICE AND DISH WASHER

CROSS REFERENCE TO RELATED APPLICATIONS

This application is a US National Stage Application under 35 USC § 371 of PCT Application No. PCT/CN2019/102882, published as WO 2020/043102 on Mar. 5, 2020, filed on Aug. 27, 2019, which claims priority of the Chinese Patent Application No. 201810998217.4 filed on Aug. 29, 2018, of the Chinese Patent Application No. 201920139252.0 filed on Jan. 25, 2019, and of the Chinese Patent Application No. 201920139239.5 filed on Jan. 25, 2019, which are each fully incorporated by reference herein.

TECHNICAL FIELD

The present disclosure relates to a detergent dispensing device, and also relates to a dishwasher including the detergent dispensing device.

BACKGROUND

A dishwasher is a household appliance. In some dishwashers, a detergent dispensing device is used to dispense detergent. The existing detergent dispensing devices occupy a large space and has a small storage space.

SUMMARY OF THE INVENTION

At least one embodiment of the present disclosure provides a detergent dispensing device for a dishwasher, which includes a storage box, a discharge pump, and a pipeline module. The storage box includes a first half shell and a second half shell fixedly connected to each other in a first direction to define a storage cavity for storing detergent. The discharge pump is configured to suck the detergent from the storage cavity and to dispense the detergent to the outside of the detergent dispensing device. The pipeline module includes a filling channel for filling detergent to the storage cavity, an inlet channel for extracting the detergent from the storage cavity by the discharge pump, and an output channel for dispensing the detergent by the discharge pump. The second half shell defines a pump accommodating space for accommodating at least a part of the discharge pump.

For example, in some embodiments of the present disclosure, the storage cavity includes a first storage cavity for storing a first detergent and a second storage cavity for storing a second detergent. The discharge pump is configured to suck the first detergent from the first storage cavity and to dispense the first detergent to the outside of the detergent dispensing device, and to suck the second detergent from the second storage cavity and to dispense the second detergent to the outside of the detergent dispensing device. The pipeline module includes a first filling channel for filling the first detergent to the first storage cavity, a second filling channel for filling the second detergent to the second storage cavity, a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump.

For example, in some embodiments of the present disclosure, one ends of the first inlet channel and of the second inlet channel are respectively connected to a first intake port and a second intake port of the discharge pump. The other ends of the first inlet channel and of the second inlet channel are respectively communicated with the first storage cavity and the second storage cavity. One ends of the first outlet channel and of the second outlet channel are respectively connected to a first outlet and a second outlet of the discharge pump. The other ends of the first outlet channel and of the second outlet channel are communicated with the outside of the detergent dispensing device.

For example, in some embodiments of the present disclosure, the detergent dispensing device further includes at least two filling caps. The first filling channel and the second filling channel are respectively communicated with the first storage cavity and the second storage cavity, and are respectively covered by the two filling caps. Each filling cap is provided with a first one-way valve that is unidirectionally communicated from the outside of the storage cavity to the inside of the storage cavity.

For example, in some embodiments of the present disclosure, the filling caps are each screwed into a corresponding one of the first filling channel and the second filling channel along a screw-in circumferential direction. The filling caps each has a filling cap connecting portion which is in the shape of a hook that opens in the screw-in circumferential direction. A wall defining the corresponding one of the first filing channel and the second filling channel is provided with a pipeline module connection portion which is in the shape of a hook that opens in opposite direction of the screw-in circumferential direction. The filling cap connecting portion has a protrusion, and the pipeline module connecting portion has a recess. The filling cap connection portion and the pipeline module connection portion are hooked to each other with the protrusion inserted into the recess.

For example, in some embodiments of the present disclosure, the second half shell includes a bottom wall, a normal direction of which is parallel to a first direction. The first storage cavity includes a first chamber and a second chamber separated by a first partition protruding from the bottom wall of the second half shell. The second storage cavity includes a third chamber and a fourth chamber separated by a second partition protruding from the bottom wall of the second half shell. The third chamber and the fourth chamber are communicated with each other through a gap between the second partition and the first half shell. The first chamber and the second chamber are communicated with each other through a gap between the first partition and the first half shell. The second chamber is closer to a bottom installation side of the detergent dispensing device than the first chamber, and the fourth chamber is closer to the bottom installation side than the third chamber.

For example, in some embodiments of the present disclosure, the detergent dispensing device further includes at least two filling caps. The first filling channel and the second filling channel are arranged in the first half shell, and the first filling channel and the second filling channel are respectively communicated with the first storage cavity and the second storage cavity and are respectively covered by the two filling caps. The first filling channel and the second filling channel are closer to a top installation side opposite to the bottom installation side than to the bottom installation side.

For example, in some embodiments of the present disclosure, the detergent dispensing device further includes a first liquid level sensor and a second liquid level sensor. The first liquid level sensor is configured to sense a first liquid level in the first storage cavity, and the second liquid level sensor is configured to sense a second liquid level in the second storage cavity.

For example, in some embodiments of the present disclosure, the discharge pump includes a first discharge pump and a second discharge pump which are separate. The first discharge pump is configured to suck the first detergent from the first storage cavity and to dispense the first detergent to the outside of the detergent dispensing device. The second discharge pump is configured to suck the second detergent from the second storage cavity and to dispense the second detergent to the outside of the detergent dispensing device.

For example, in some embodiments of the present disclosure, each of the first discharge pump and the second discharge pump includes a motor, a chamber body, a transmission system, and a pump housing. The chamber body has a pull rod, and reciprocating movement of the pull rod causes the volume of the chamber body to change. The transmission system is coupled between an output shaft of the motor and the pull rod of the chamber body, and converts the rotational movement of the motor into the reciprocating motion of the pull rod of the chamber body. The pump housing accommodates the motor, the chamber body and the transmission system.

For example, in some embodiments of the present disclosure, the detergent dispensing device further includes a sensing device for sensing the reciprocating movement of the pull rod. The sensor device includes a first sensor element and a second sensor element. The first sensing element is fixed relative to the pump housing. The second sensing element cooperates with the first sensing element and is fixed to any one of the output shaft of the motor, the transmission system or the pull rod of the chamber body.

For example, in some embodiments of the present disclosure, the second sensing element is fixed to the pull rod of the chamber body.

For example, in some embodiments of the present disclosure, the overall height of the transmission system in normal direction of a plane formed by an axis of the motor and an axis of the chamber body is less than or equal to a diameter of the motor, the axis of the motor passing through its output shaft, the axis of the chamber body being parallel to a direction in which the volume changes.

For example, in some embodiments of the present disclosure, the axis of the motor is parallel to the axis of the chamber body.

For example, in some embodiments of the present disclosure, the motor, the transmission system, and the chamber body are sequentially arranged in a U shape.

For example, in some embodiments of the present disclosure, the transmission system is composed of a first-stage worm gear transmission, a second-stage gear transmission, and a third-stage gear transmission. A worm gear in the first-stage worm gear transmission is coaxially arranged with a driving gear in the second-stage gear transmission, and a driven gear in the second-stage gear transmission is coaxially arranged with a driving gear in the third-stage gear transmission For example, in some embodiments of the present disclosure, the motor is a DC motor.

For example, in some embodiments of the present disclosure, the first half shell includes an upper cover plate and a cover, the second half shell and the upper cover plate defining the storage cavity, and the cover being fixed to the upper cover plate to cover and isolate the discharge pump and the pipeline module.

For example, in some embodiments of the present disclosure, the detergent dispensing device further includes at least two filling caps. The first filling channel and the second filling channel are respectively communicated with the first storage cavity and the second storage cavity, and are respectively covered by the two filling caps. The pipeline module includes a pipeline module body, and the pipeline module body includes a first filling channel, a second filling channel, a first inlet channel, a second inlet channel, a first outlet channel, and a second outlet channel. The pipeline module body is integrally formed.

For example, in some embodiments of the present disclosure, the pipeline module body and the upper cover plate are integrally formed.

For example, in some embodiments of the present disclosure, one ends of the first inlet channel and of the second inlet channel are respectively connected to the first intake port and the second intake port of the discharge pump, and the other ends of the first inlet channel and of the second inlet channel are respectively communicated with the first storage cavity and the second storage cavity. One ends of the first outlet channel and of the second outlet channel are respectively connected to a first outlet and a second outlet of the discharge pump, and the other ends of the first outlet channel and of the second outlet channel are respectively communicated with the outside of the detergent dispensing device. One ends of the first filling channel and of the second filling channel are respectively communicated with the outside of the pipeline module and covered by the filling cap, and the other ends of the first filling channel and the second filling channel are respectively communicated with the first storage cavity and the second storage cavity.

For example, in some embodiments of the present disclosure, the second storage cavity further includes a second inlet cavity. The other end of the first filling channel is opened to the first chamber, and the other end of the first filling channel is opened to the second chamber. The other end of the second filling channel is opened to the third chamber, and the other end of the second filling channel is opened to the second inlet cavity. The fourth chamber is in communication with the second inlet cavity through a second inlet guiding hole. The height of the second inlet guiding hole is smaller than the height of the second partition.

For example, in some embodiments of the present disclosure, the second storage cavity further includes a fifth chamber and a sixth chamber separated by a third partition protruding from the bottom wall of the second half shell. The fifth chamber and the sixth chamber are communicated with each other through a gap between the third partition and the first half shell, and the sixth chamber is closer to the bottom installation side than the fifth chamber. The third chamber and the fifth chamber are in communication with each other through a through hole. The sixth chamber is communicated with the second inlet cavity through the second inlet guiding hole. The height of the second inlet guiding hole is smaller than the height of the third partition. The height of the through hole is not lower than the height of the second partition and the height of the third partition.

For example, in some embodiments of the present disclosure, the second inlet guiding hole makes the fourth chamber and the sixth chamber communicated with the second inlet cavity respectively at locations of the fourth chamber and the sixth chamber close to the bottom installation side.

For example, in some embodiments of the present disclosure, the box body is provided with an inner side panel surrounding its outer periphery and an outer side panel located outside the inner side panel, the inner side panel and the upper cover plate being welded together to close the storage box. The height of the inner side panel is higher than that of the outer side panel.

For example, in some embodiments of the present disclosure, the height of the inner side panel is higher than that of the outer side panel. The first half shell has a boss protruding toward the outer side panel. An end face of the outer side panel abuts against an end face of the boss.

For example, in some embodiments of the present disclosure, both ends of the pump accommodating space of the second half shell in the first direction have a first opening close to the first half shell and a second opening away from the first half shell to allows the discharge pump to protrude from the first opening and the second opening.

For example, in some embodiments of the present disclosure, the contour of the second opening is larger than that of the discharge pump, so that the discharge pump can be detachably fixed to the second half shell from the second opening.

For example, in some embodiments of the present disclosure, the storage cavity includes a first storage cavity for storing a first detergent and a second storage cavity for storing a second detergent. The pipeline module includes a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump.

For example, in some embodiments of the present disclosure, the pipeline module includes a first inlet tube in which the first inlet channel extends, and a second inlet tube in which the second inlet channel extends, a first outlet tube in which the first outlet channel extends and a second outlet tube in which the second outlet channel extends. The first inlet tube, the second inlet tube, the first outlet tube and the second outlet tube are each a separate integrated piece.

For example, in some embodiments of the present disclosure, the first half shell and the second half shell are respectively an integral piece, and the first half shell and second half shell define an internal space in which the storage cavity and the pump are accommodated. The first inlet tube, the second inlet tube, the first outlet tube, and the second outlet tube are installed in the internal space.

For example, in some embodiments of the present disclosure, a first liquid level sensor is configured to sense a first liquid level in the first storage cavity. The first liquid level sensor includes a first conductive probe and a second conductive probe, and is in a first sensing state in which the first conductive probe and the second conductive probe are electrically connected to each other or a second sensing state in which the first conductive probe and the second conductive probe are electrically disconnected from each other. The first storage cavity has a first side wall close to the bottom installation side and a part of the bottom wall. The first conductive probe and the second conductive probe are arranged in the second chamber, and are arranged such that when the storage box is in a vertical position or a horizontal position, the first liquid level sensor is in the same state. In the horizontal position, the first direction is parallel to the gravity direction, and the bottom wall is located at downstream side of the first storage cavity in the gravity direction. In the vertical position, the first direction is perpendicular to the gravity direction, and the first side wall is located at downstream side of the first storage cavity in the gravity direction.

For example, in some embodiments of the present disclosure, the second chamber is located at a corner of the first storage cavity. The first partition includes a first sub partition parallel to the first side wall and a second sub partition perpendicular to the first side wall and the bottom wall. The second conductive probe is closer to the first side wall and the bottom wall than the first conductive probe. A first length c of a first side of the second sub partition bordering the first sub partition, and a second length f of a second side of the second sub partition bordering the first side wall, and a first distance d between the first conductive probe and the bottom wall meet: $c>d$ and $f>d$.

For example, in some embodiments of the present disclosure, the first distance d, a first height b of the second sub partition between the first sub partition and the first side wall, a second distance e between the first conductive probe and the first side wall, and a third length a of the first side wall in the first direction meet: $a*e=b*d$.

For example, in some embodiments of the present disclosure, the second length f, the height b, the third length a, and the second distance e meet: $f*b/2\geq a*e$.

For example, in some embodiments of the present disclosure, the first length c and the second length f meet: $f>c$.

For example, in some embodiments of the present disclosure, the second half shell is provided with a first sump near the bottom installation side in the first chamber, and with a second sump near the bottom installation side in the third chamber. Each of the first sump and the second sump protrudes outward. An opening at the other end of the first inlet channel is arranged at the first sump, and an opening at the other end of the second inlet channel is arranged at the second sump.

For example, in some embodiments of the present disclosure, one ends of the first inlet channel and of the second inlet channel are respectively connected to the first intake port and the second intake port of the discharge pump, and the other ends of the first inlet channel and of the second inlet channel are respectively communicated with the first storage cavity and the second storage cavity. One ends of the first outlet channel and of the second outlet channel are respectively connected to a first outlet and a second outlet of the discharge pump, and the other ends of the first outlet channel and of the second outlet channel are respectively communicated with the outside of the detergent dispensing device. An outer side of the first half shell opposite to the second half shell is provided with a first detergent guiding groove to which the other end of the first outlet channel is opened and a second detergent guiding groove to which the other end of the second outlet channel is opened.

For example, in some embodiments of the present disclosure, one ends of the first inlet channel and of the second inlet channel are respectively connected to the first intake port and the second intake port of the discharge pump, and the other ends of the first inlet channel and of the second inlet channel are respectively communicated with the first storage cavity and the second storage cavity. One ends of the first outlet channel and of the second outlet channel are respectively connected to a first outlet and a second outlet of the discharge pump, and the other ends of the first outlet channel and of the second outlet channel are respectively communicated with the outside of the detergent dispensing device. The opening at the other end of the first outlet channel and the opening at the other end of the second outlet channel are arranged on the outer side of the first half shell opposite to the second half shell, and both the opening at the other end of the first outlet channel and the opening at the other end of the second outlet channel are provided with a second one-way valve. The second one-way valve conducts fluid unidirectionally in a direction from inside of the storage cavity to outside of the storage cavity.

At least one embodiment of the present disclosure provides a dishwasher, including: a main body with an opening; a door closing the opening and having an inner plate and an outer plate; and the detergent dispensing device as described above. The detergent dispensing device is mounted to the door such that at least a part of the second half shell is disposed between the inner plate and the outer plate.

For example, in some embodiments of the present disclosure, the door is pivotally connected to a lower part of the main body, and is switched between an open position and a closed position by turning around a rotation axis. In the open position, the door is configured to be placed horizontally relative to the gravity direction, while in the closed position, the door is configured to be placed vertically relative to the gravity direction.

The detergent dispensing device is mounted to the door such that the bottom installation side of the detergent dispensing device is close to the pivot axis of the door.

At least one embodiment of the present disclosure provides a dishwasher, including: a main body with an opening; a door closing the opening and having an inner plate and an outer plate; and the detergent dispensing device as described above. The second half shell is located on the side of the outer plate and the upper cover plate is located on the side of the inner plate. The pipeline module is fixed to the upper cover plate from one side of the inner plate. The inner plate is sandwiched between the cover and the upper cover plate.

At least one embodiment of the present disclosure provides a dishwasher including: a main body having an opening; a door closing the opening and having an outer plate and an inner plate; and a detergent dispensing device including a storage box, a pipeline module, and a discharge pump in fluid communication with the pipeline module, wherein the storage box is arranged between the inner plate and the outer plate, and includes a box body located on the side of the outer plate and an upper cover plate located on the side of the inner plate, the box body and the upper cover plate defining a storage cavity for storing detergent; the pipeline module is fixed to the upper cover plate from one side of the inner plate.

For example, in some embodiments of the present disclosure, the detergent dispensing device further includes a cover that is fixed to the upper cover plate and covers and liquid-isolates the discharge pump and the pipeline module, the inner plate being sandwiched between the cover and the upper cover plate.

For example, in some embodiments of the present disclosure, the storage cavity includes a first storage cavity for storing a first detergent and a second storage cavity for storing a second detergent; the discharge pump is configured to suck the first detergent from the first storage cavity, to suck the second detergent from the second storage cavity and to dispense the first detergent and the second detergent into the main body of the dishwasher; the pipeline module includes a pipeline module body and a filling cap, and the pipeline module main body includes a filling channel used for filling liquid into the first storage cavity and the second storage cavity, an inlet channel used for extracting the detergent from the first storage cavity and the second storage cavity by the discharge pump and an outlet channel used for dispensing the detergent by the discharge pump.

For example, in some embodiments of the present disclosure, the pipeline module body is integrally formed.

For example, in some embodiments of the present disclosure, the pipeline module body and the upper cover plate are integrally formed.

For example, in some embodiments of the present disclosure, the filling cap is provided with a one-way valve that allows gas to enter the pipeline module from the outside.

For example, in some embodiments of the present disclosure, the filling cap is screwed into the pipeline module body along a screw-in circumferential direction, the filling cap having a filling cap connecting portion that is in the shape of a hook opened towards the screw-in circumferential direction, while the pipeline module body having a pipeline module connecting portion which is in the shape of a hook opened in the direction opposite the screw-in circumferential direction; the filling cap connecting portion having a protrusion, while the pipeline module connecting portion having a recess; the filling cap connecting portion and the pipeline module connecting portion are hooked to each other with the protrusion inserted into the recess.

For example, in some embodiments of the present disclosure, the filling channel includes a first filling channel and a second filling channel, and the inlet channel includes a first inlet channel and a second inlet channel; one ends of the first filling channel and of the second filling channel are respectively in communication with the outside of the pipeline module and covered by the filling cap, while the other ends of the first filling channel and of the second filling channel are respectively in communication with the first storage cavity and the second storage cavity; one ends of the first inlet channel and of the second inlet channel are respectively connected to a first intake port and a second intake port of the discharge pump, while the other ends of the first inlet channel and of the second inlet channel are respectively in communication with the first storage cavity and the second storage cavity; one end of the outlet channel is connected to the outlet of the discharge pump and the other end of the outlet channel is opened into the main body.

For example, in some embodiments of the present disclosure, the outlet channel includes a first outlet channel and a second outlet channel, one ends of the first outlet channel and of the second outlet channel being respectively connected to the first outlet and the second outlet of the discharge pump, and the other ends of the first outlet channel and of the second outlet channel being respectively opened into the main body.

For example, in some embodiments of the present disclosure, the door is pivotally connected to a lower part of the main body, and is switched between an open position in which the door is placed horizontally relative to the gravity direction and a closed position in which the door is placed vertically relative to the gravity direction by turning around a rotation axis.

For example, in some embodiments of the present disclosure, the door is switched between the open position and the closed position by turning 85-90° about the axis of rotation.

For example, in some embodiments of the present disclosure, the first storage cavity includes a first chamber and a second chamber separated by a first partition, the other end of the first filling channel being opened to the first chamber, the other end of the first inlet channel being opened to the second chamber; the first chamber and the second chamber is in communication with each other through a gap between the first partition and the upper cover plate, and the second chamber is closer to the rotation axis of the door than the first chamber.

For example, in some embodiments of the present disclosure, the volume of the second chamber is less than one-fifth of the volume of the first chamber.

For example, in some embodiments of the present disclosure, the detergent dispensing device further includes a first liquid level sensor configured to sense a first liquid level in the first storage cavity when the door is in the closed position and to issue a notification when the first liquid level is lower than a first predetermined liquid level, the first predetermined liquid level being set so that when the door is turned to the open position, the other end of the inlet channel is still immersed in the first detergent.

For example, in some embodiments of the present disclosure, the box body further includes a second inlet cavity, and the second storage cavity includes a third chamber and a fourth chamber separated by a second partition. The third chamber and the fourth chamber are in communication with each other through a gap between the second partition and the upper cover plate, and the fourth chamber is closer to the axis of rotation of the door than the third chamber. The other end of the second filling channel is opened to the third chamber, while the other end of the second filling channel is opened to the second inlet cavity. The fourth chamber is is communication with the second inlet cavity through a second inlet guiding hole, the height of the second inlet guiding hole is smaller than that of the second partition.

For example, in some embodiments of the present disclosure, the second storage cavity further includes a fifth chamber and a sixth chamber separated by a third partition, the fifth chamber and the sixth chamber being in communication with each other through a gap between the third partition and the upper cover plate. The sixth chamber is closer to the rotation axis of the door than the fifth chamber. The third chamber is in communication with the fifth chamber through a through hole, while the sixth chamber is in communication with the second inlet cavity through the second inlet guiding hole, the height of the second inlet guiding hole being smaller than that of the third partition.

For example, in some embodiments of the present disclosure, the height of the through hole is not lower than the height of the second partition and the height of the third partition.

For example, in some embodiments of the present disclosure, the second inlet guiding hole makes the fourth chamber and the sixth chamber communicated with the second inlet cavity respectively at locations of the fourth chamber and the sixth chamber close to the axis of rotation.

For example, in some embodiments of the present disclosure, the detergent dispensing device further includes a second liquid level sensor configured to sense a second liquid level in the second storage cavity when the door is in the closed position and to issue a notification when the second liquid level is lower than a second predetermined liquid level, the second predetermined liquid level being set so that when the door is turned to the open position, the second inlet guiding hole is still immersed in the second detergent.

For example, in some embodiments of the present disclosure, the volume of the fourth chamber is less than one-fifth of the volume of the third chamber, and the volume of the sixth chamber is less than one-fifth of the volume of the fifth chamber.

For example, in some embodiments of the present disclosure, the box body is provided with an inner side panel surrounding its outer periphery and an outer side panel located outside the inner side panel, the inner side panel and the upper cover plate being welded together to close the storage box, and the height of the inner side panel being higher than that of the outer side panel.

For example, in some embodiments of the present disclosure, the upper cover plate has a boss protruding toward the outer side panel, and an end face of the outer side panel abuts against an end face of the boss.

BRIEF DESCRIPTION

In order to explain the technical solutions of the embodiments of the present disclosure more clearly, the following will briefly introduce the drawings that need to be used in the embodiments. It should be understood that the following drawings only show certain embodiments of the present disclosure, and therefore should not be regarded as a limitation of the scope of protection. For those of ordinary skill in the art, other relevant drawings can be obtained based on these drawings without creative work.

Figure 35A:
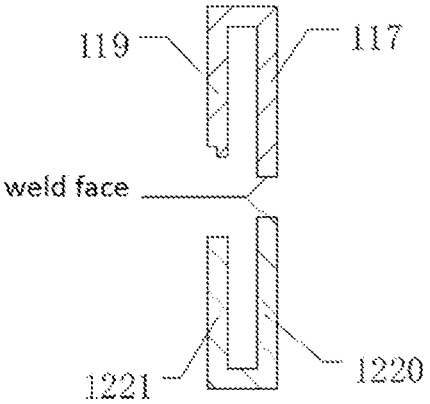
Figure 35B:
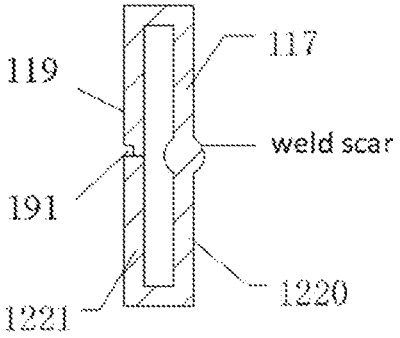
Figure 36:
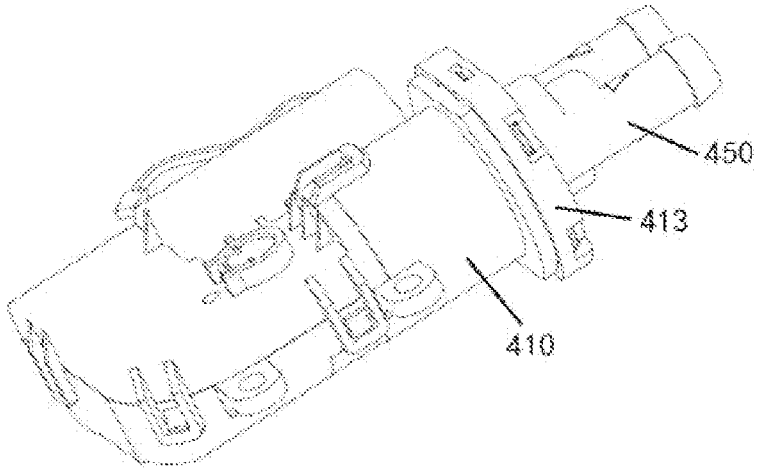
Figure 37A:
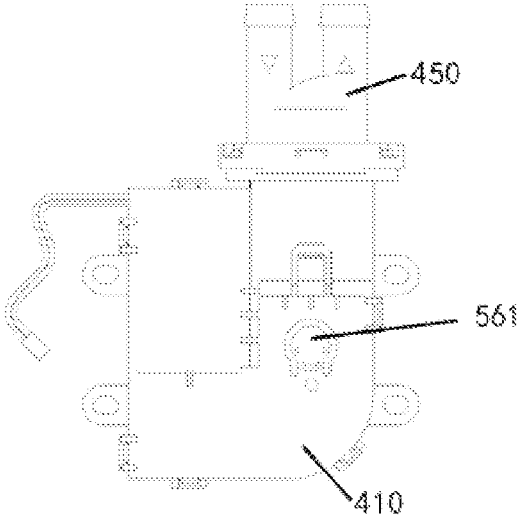
Figure 37B:
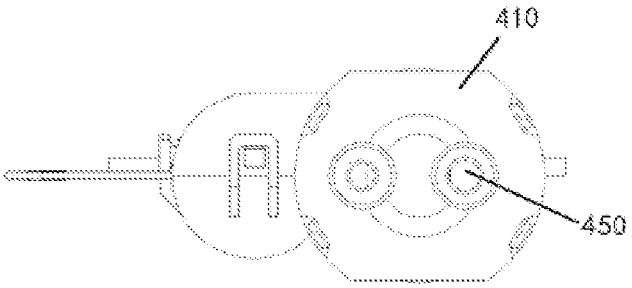
Figure 37C:
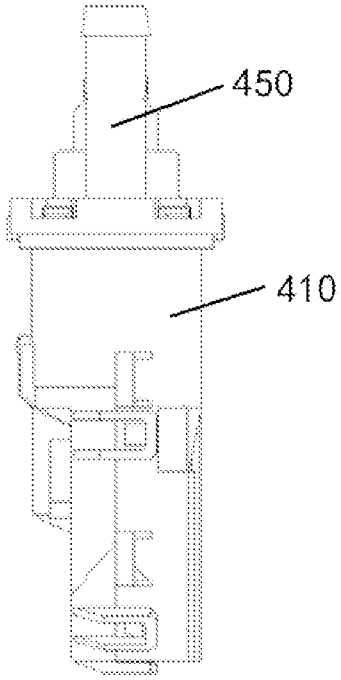
Figure 38:
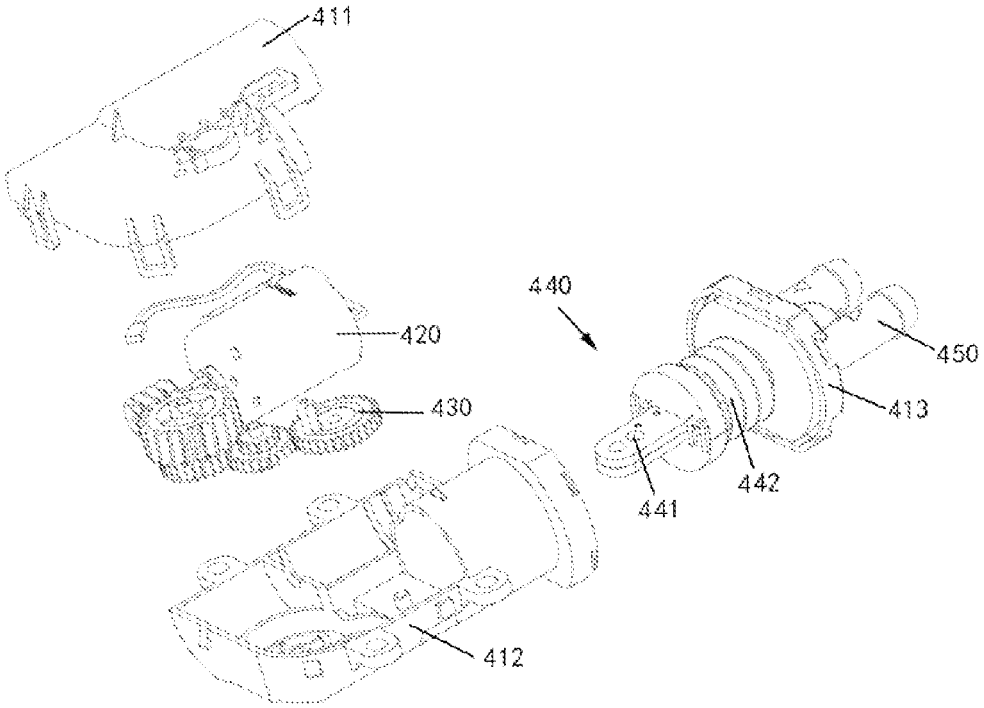
Figure 39:
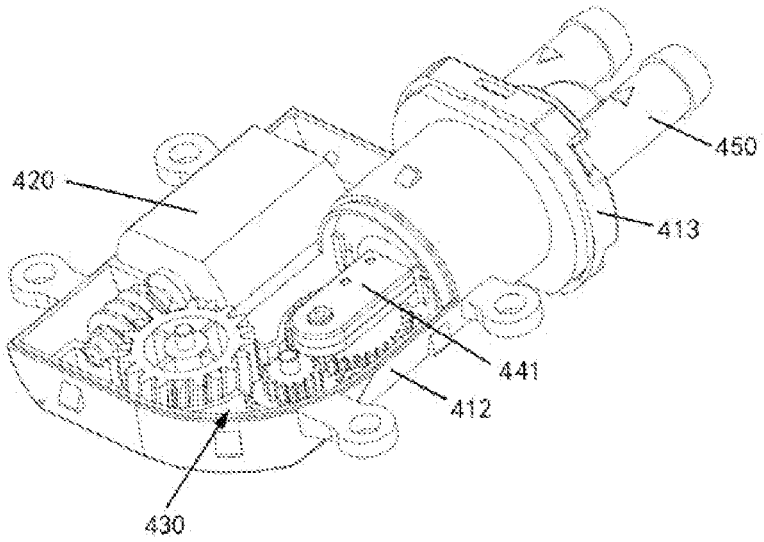
Figure 40:
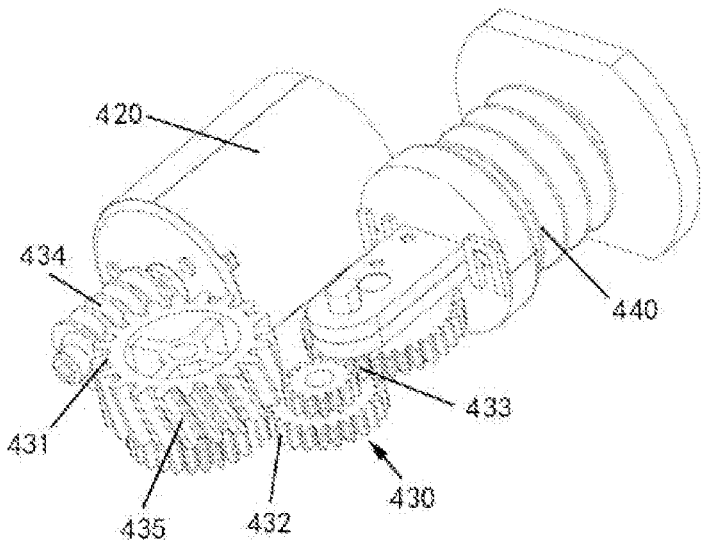
Figure 41:
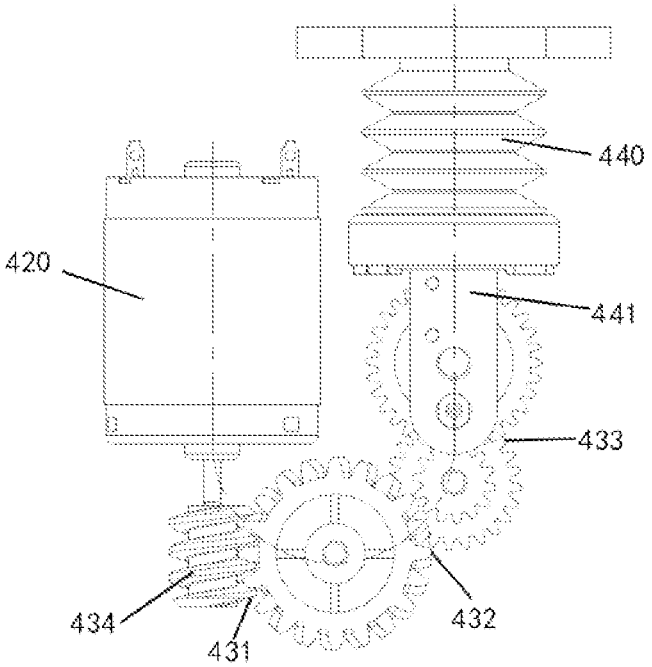
Figure 42:
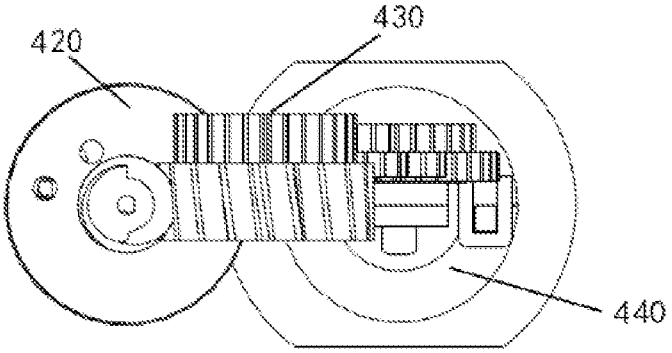
Figure 43A:
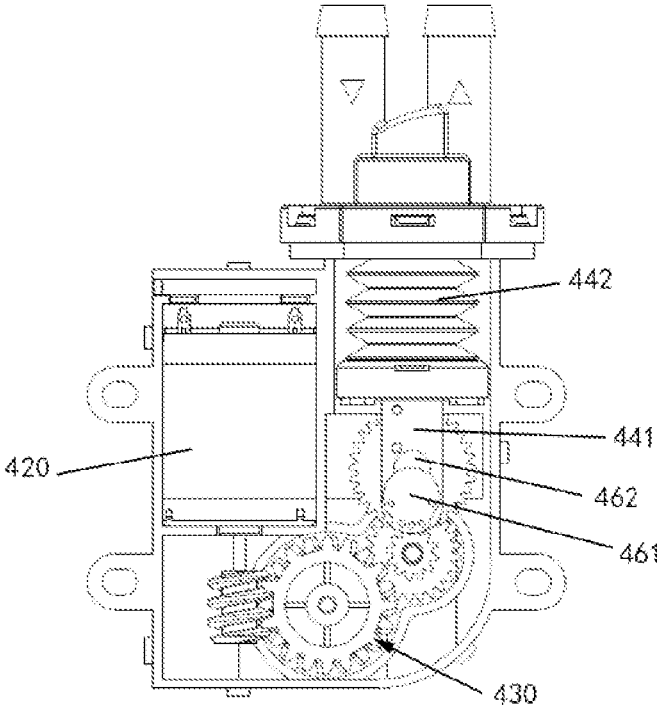
Figure 43B:
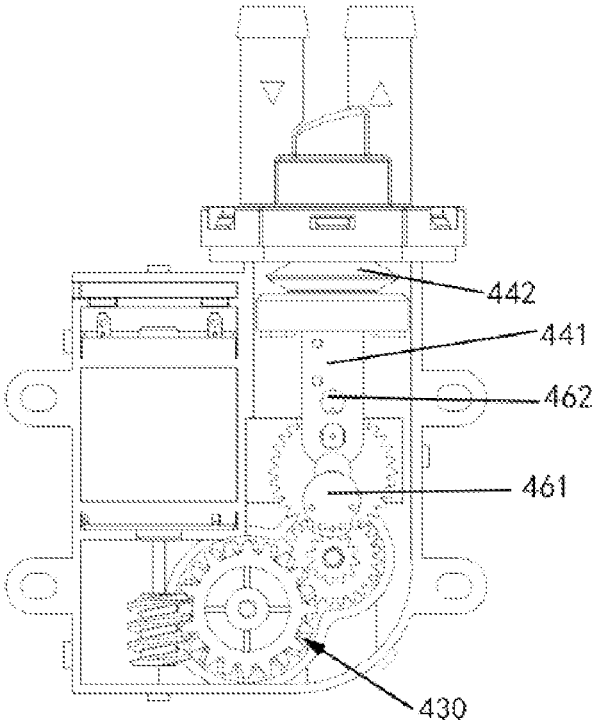
Figure 44A:
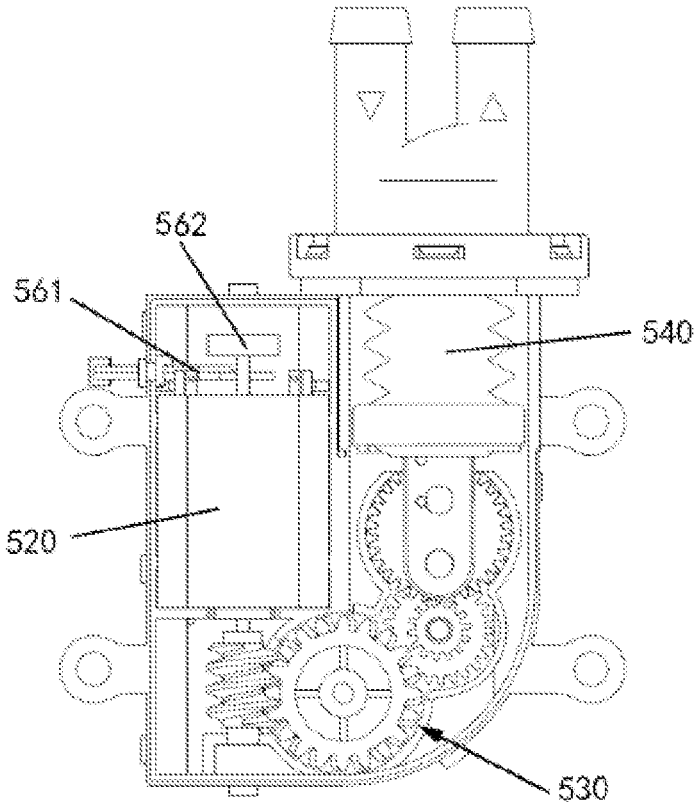
Figure 44B:
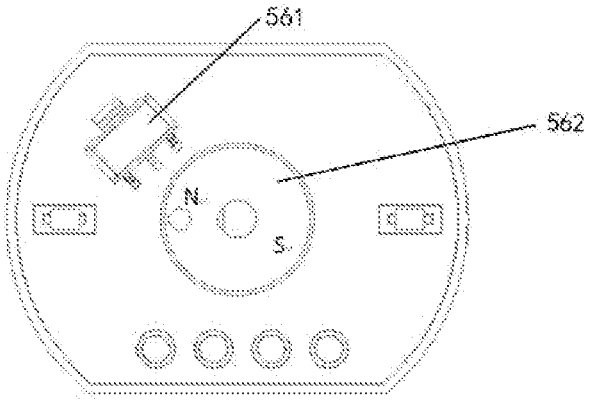
Figure 45:
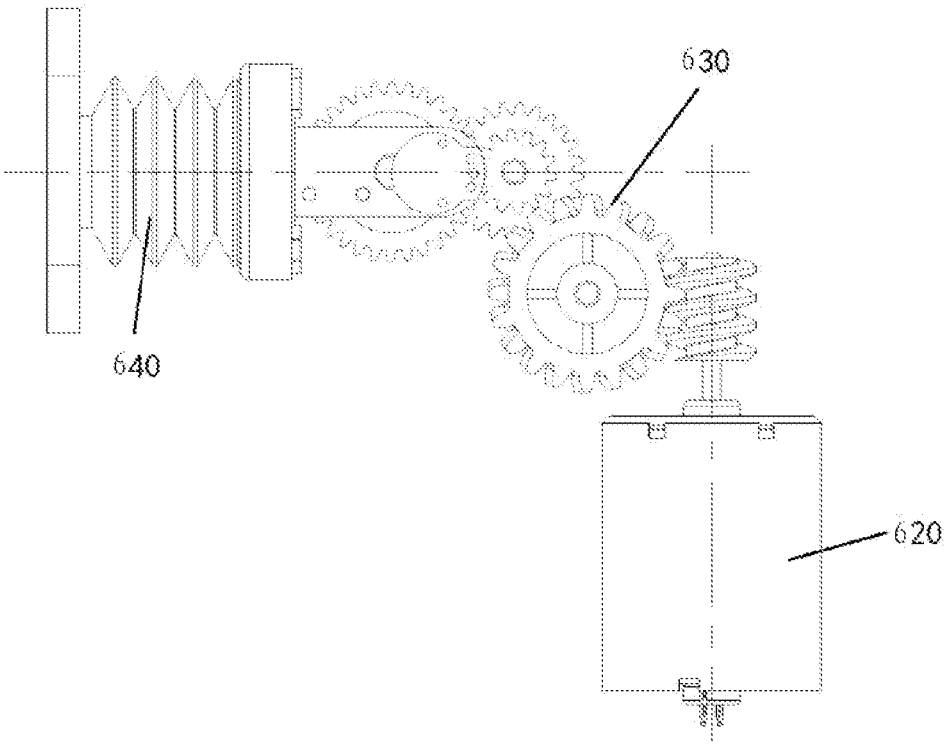
Figure 46:
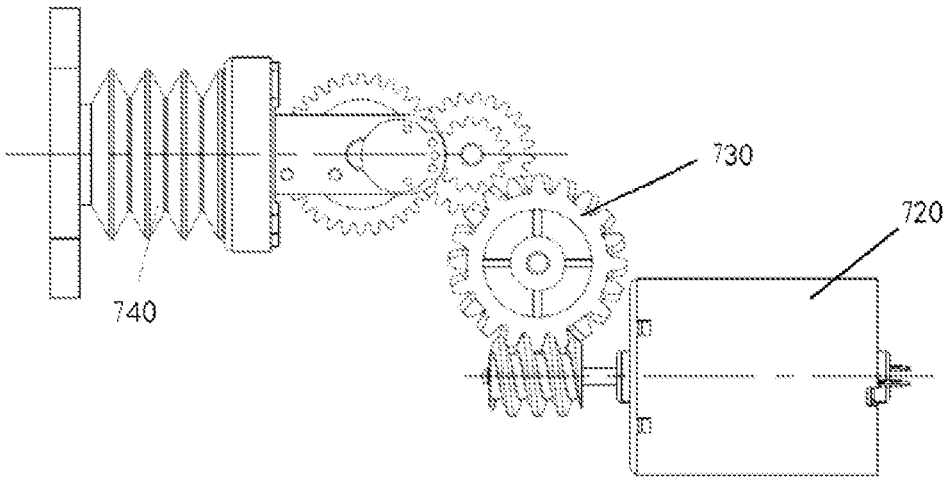

FIGS. 35A and 35B schematically show a first inner side panel and a second inner side panel as well as a first outer side panel and a second outer side panel respectively before and after the first half shell and the second half shell are welded to each other;

FIG. 36 is a perspective view of a discharge pump according to an embodiment of the present disclosure;

FIG. 37A is a top view of the discharge pump shown in FIG. 36;

FIG. 37B is a side view of the discharge pump shown in FIG. 36 viewed along the chamber body axis;

FIG. 37C is a side view of the discharge pump shown in FIG. 36 viewed perpendicular to the cavity axis;

FIG. 38 is an exploded perspective view of the discharge pump shown in FIG. 36;

FIG. 39 is a perspective view of the discharge pump shown in FIG. 36 with the first half shell removed;

FIG. 40 is a perspective view of the discharge pump shown in FIG. 36, with the pump housing removed;

FIG. 41 is a top view of the discharge pump shown in FIG. 36, with the pump housing removed;

FIG. 42 is a view of the discharge pump shown in FIG. 36 viewed along an axis of a motor, with the pump housing removed;

FIG. 43A is a top view of the discharge pump shown in FIG. 36, which shows a sensing device, and a pull rod is moved to a first position;

FIG. 43B is a top view of the discharge pump shown in FIG. 36, which shows the sensing device, and the pull rod is moved to the second position;

FIG. 44A is a top view of a discharge pump according to another embodiment of the present disclosure, which shows a sensing device;

FIG. 44B is a view of the sensor device shown in FIG. 44A viewed along the axis of the motor;

FIG. 45 is a top view of a discharge pump according to another embodiment of the present disclosure, with the pump housing removed;

FIG. 46 is a top view of a discharge pump according to another embodiment of the present disclosure, with the pump housing removed.

DETAILED DESCRIPTION OF DISCLOSURE

In order to make the objectives, technical solutions, and advantages of the embodiments of the present disclosure clearer, the technical solutions of the embodiments of the present disclosure will be described clearly and completely in conjunction with the accompanying drawings of the embodiments of the present disclosure. Obviously, the described embodiments are part of the embodiments of the present disclosure, rather than all of the embodiments. Based on the described embodiments of the present disclosure, all other embodiments obtained by those of ordinary skill in the art without inventive work are within the protection scope of the present disclosure.

Unless otherwise defined, the technical terms or scientific terms used in the present disclosure shall have the usual meanings understood by those with ordinary skills in the field to which this disclosure belongs. The words "first", "second" and similar words used in the present disclosure do not indicate any order, quantity, or importance, but are only used to distinguish different components. "Include" or "comprise" and other similar words mean that the elements or objects appearing in front of the word cover the elements or objects listed after the word and their equivalents, without excluding other elements or objects. The directional terms such as "upper", "lower", "left", "right", "top", "bottom", "clockwise", "counterclockwise" mentioned in the text are only used to describe relative position relationships with respect to the drawings, and when the absolute position of a described object changes, the relative position relationship may also change accordingly.

At least one embodiment of the present disclosure provides a detergent dispensing device for a dishwasher, which includes a storage box, a discharge pump, and a pipeline module. The storage box includes a first half shell and a second half shell fixedly connected to each other in a first direction to define a storage cavity for storing detergent. The discharge pump is configured to suck the detergent from the storage cavity and to dispense the detergent to the outside of the detergent dispensing device. The pipeline module includes a filling channel for filling detergent to the storage cavity, an inlet channel for extracting the detergent from the storage cavity by the discharge pump, and an output channel for dispensing the detergent by the discharge pump. The second half shell defines a pump accommodating space for accommodating at least a part of the discharge pump.

Since the storage cavity and the pump accommodating space are not positioned stacked in the first direction, and the second half shell defines the pump accommodating space for accommodating at least a part of the discharge pump, the thickness of the detergent dispensing device in the first direction decreases.

Figure 1:
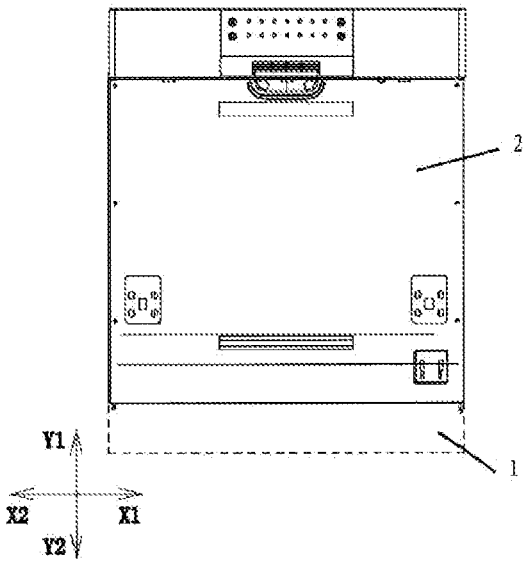
FIG. 1 is a front view of a dishwasher according to an embodiment of the present disclosure.
Figure 2:
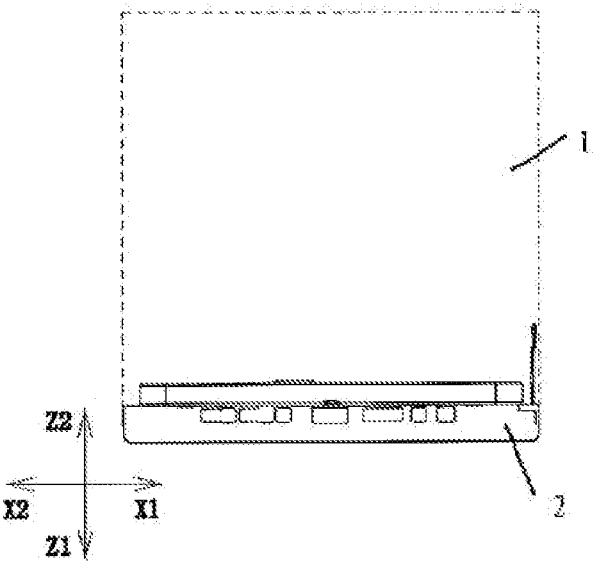
FIG. 2 is a top view of a dishwasher according to an embodiment of the present disclosure.
Figure 3:
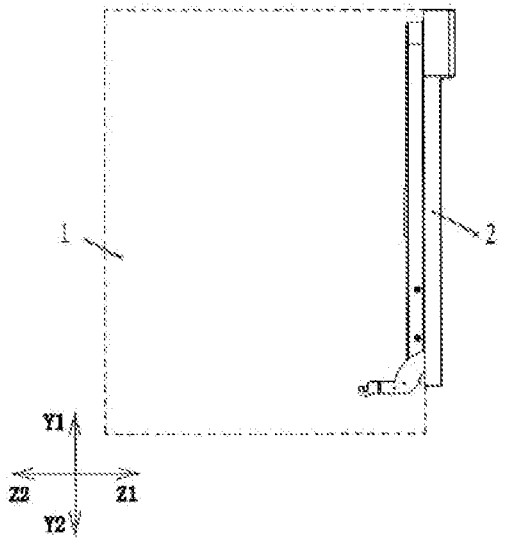
FIG. 3 is a side view of a dishwasher according to an embodiment of the present disclosure, wherein the door of the dishwasher is closed.
Figure 4:
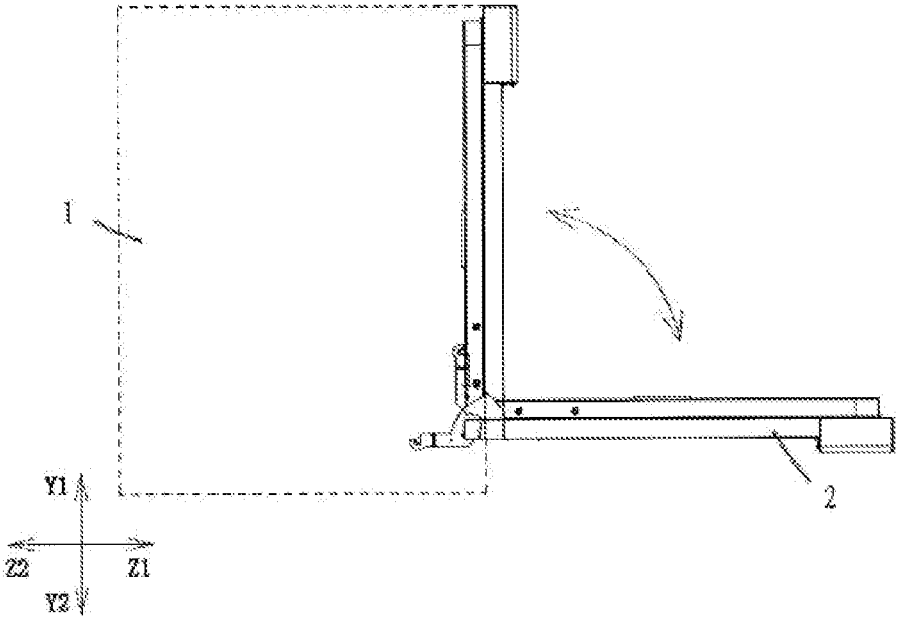
FIG. 4 is a side view of a dishwasher according to an embodiment of the present disclosure, wherein the door of the dishwasher is opened.
Figure 5:
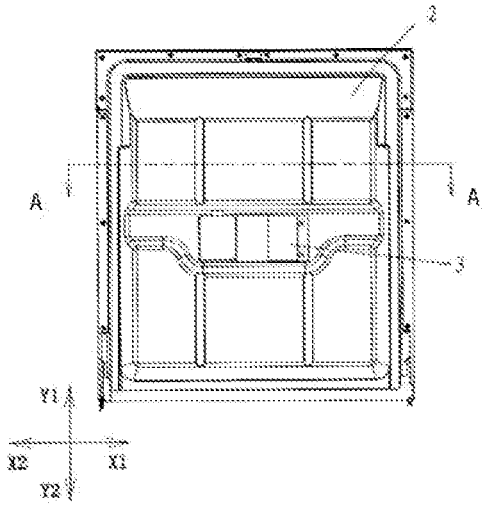
FIG. 5 is an internal view of a dishwasher according to an embodiment of the present disclosure, which shows the inside of the door of the dishwasher, and wherein the door is closed.
Figure 6:
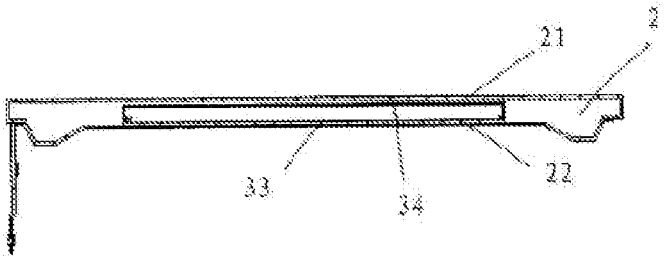
FIG. 6 is a cross-sectional view of the door of the dishwasher according to an embodiment of the present disclosure, taken along the line A-A in FIG. 5.

FIGS. 1-5 show views of a dishwasher according to an embodiment of the present disclosure. As shown in FIGS. 1-4, the dishwasher has a main body 1 (shown in dashed lines) of a cavity for placing dishes to be washed. The cavity has an opening for users to access the inside of the cavity to place and take out the dishes, etc. In addition, the dishwasher also has a door 2 that closes the opening. The door 2 may be pivotally connected to the main body 1 at the lower part of the main body 1. As shown in FIGS. 3 and 4, the door 2 can be rotated by an angle to switch between an open position and a closed position. For example, the angle is 85-90 degrees. As shown in FIG. 4, in this open position, the door 2 may be in a horizontal position relative to the gravity direction. As shown in FIG. 3, in this closed position, the door 2 may be in a vertical position relative to the gravity direction. The arrow in FIG. 4 schematically shows the direction in which the door 2 switches between the open position and the closed position. As shown in FIG. 5, the detergent dispensing device 3 may be installed on the door 2. As shown in FIG. 6, the detergent storage box of the detergent dispensing device 3 may be arranged between an outer plate 21 and an inner plate 22 of the door 2. The outer panel 21 and the inner panel 22 constitute the exterior of the door 2, the outer panel 21 is exposed to the outside of the dishwasher, and the inner panel 22 is exposed to the inside of the main body 1 when the door 2 is in the closed position.

Figure 7:
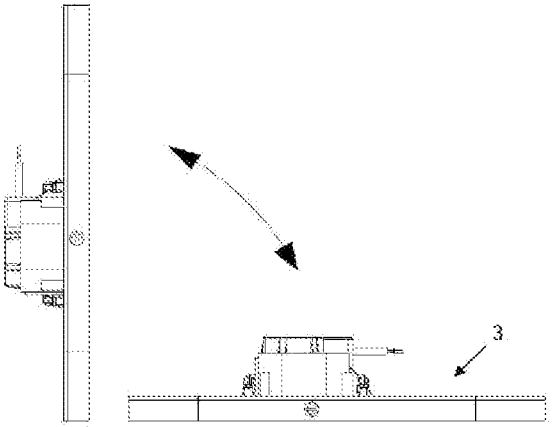
FIG. 7 is a side view of a detergent dispensing device according to an embodiment of the present disclosure.

FIG. 7 shows a side view of the detergent dispensing device 3 according to an embodiment of the present disclosure, in which the arrow shows the position change direction of the door 2 and the door 2 is switched between the closed position shown on the left in FIG. 7 and the open position shown on the lower side in FIG. 7. When the door 2 is in the open position, the user can add detergent to the detergent dispensing device 3. When the door 2 is in the closed position, the dishwasher can perform normal washing work.

Figure 8:
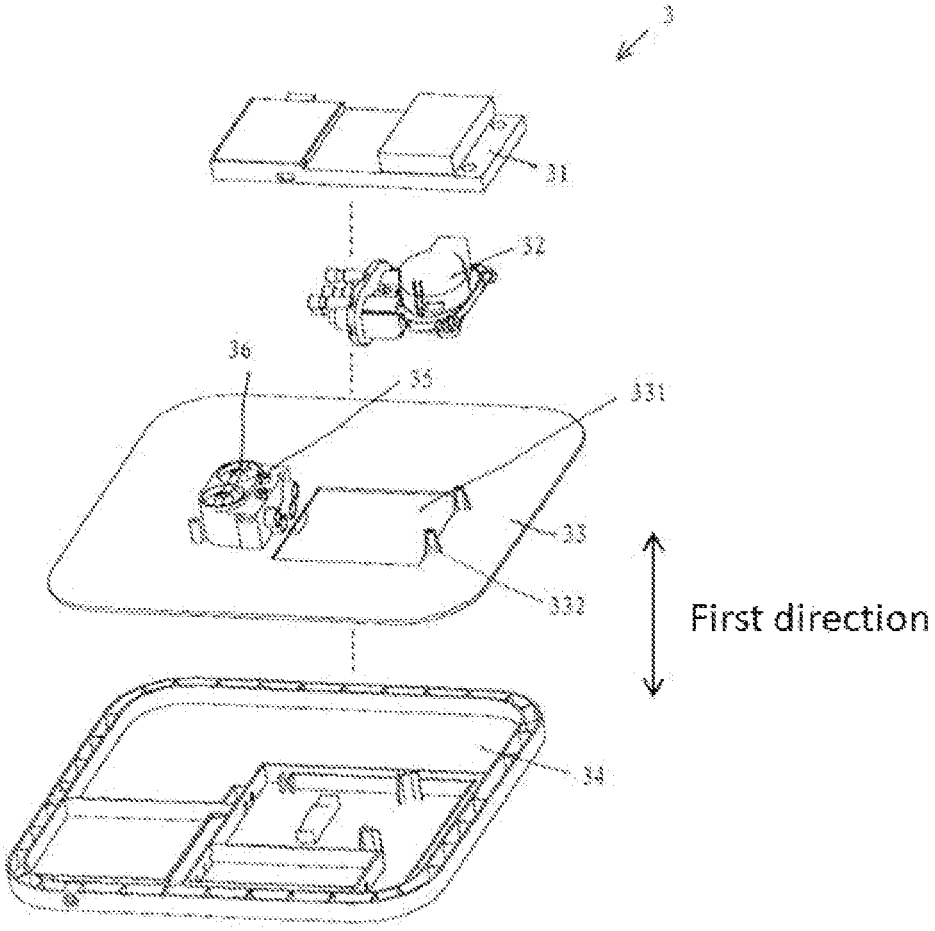
FIG. 8 is an exploded perspective view of a detergent dispensing device according to an embodiment of the present disclosure.
Figure 9:
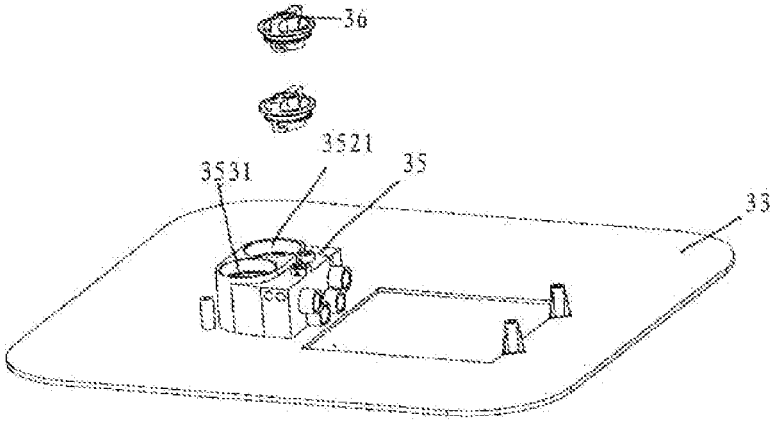
FIG. 9 is a partially exploded perspective view of a detergent dispensing device according to an embodiment of the present disclosure.
Figure 10A:
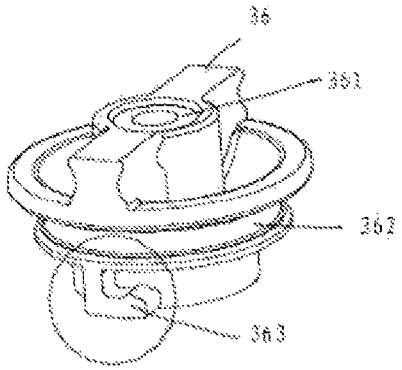
FIG. 10A is a perspective view of a filling cap according to an embodiment of the present disclosure.
Figure 10B:
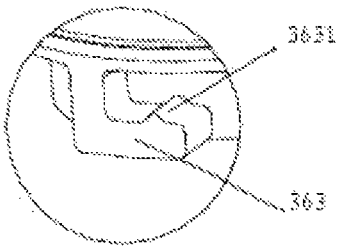
FIG. 10B is a partial enlarged view of the perspective view of the filling cap in FIG. 10A.

FIGS. 8 and 9 show perspective views of a detergent dispensing device according to an embodiment of the present disclosure. As shown in FIGS. 8 and 9, the detergent dispensing device 3 includes a cover 31, a discharge pump 32, a pipeline module, and a storage box. The storage box includes an upper cover plate 33 and a box body 34 which together form a storage cavity, and the pipeline module includes a pipeline module body 35 and a filling cap 36 that closes the filling ports 3521, 3531 of the pipeline module body 35. The cover 31 can cover the discharge pump 32 and the pipeline module to protect them.

In this embodiment, the cover 31 and the upper cover plate 33 can be used as the first half shell, and the box body 34 can be used as the second half shell. As shown in FIG. 8, the first half shell and the second half shell are fixedly connected to each other in the first direction (the up-down direction in FIG. 8).

For example, the cover 31 may be fixed to the upper cover plate 33 by screws. The inner plate of the door 2 can be sandwiched between the cover 31 and the upper cover plate 33, and the storage box can be completely placed between the inner plate 22 and the outer plate 21 of the door 2. In this way, since the storage box is placed between the inner plate 22 and the outer plate 21, the space utilization rate of the door 2 is improved without changing the outline of the dishwasher, and the volume of the storage cavity is increased. The user can add more detergent to the storage cavity to achieve multiple use with one adding. The cover 31 is arranged outside the pipeline module, which is advantageous in that when the discharge pump 32 sucks the detergent during the washing operation, enough air in the cover 31 can be supplemented into a one-way air valve 361 of the pipeline module to realize stable work of the discharge pump 32.

The upper cover plate 33 and the box body 34 together form a storage cavity for storing detergent. For example, the upper cover plate 33 and the box body 34 can be connected by welding. In addition, as shown in FIGS. 8 and 9, the upper cover plate 33 is provided with an avoiding hole 331 for avoiding the discharge pump 32. In this embodiment, the storage box further includes a pump accommodating space which is used for accommodating the discharge pump 32 at the avoiding hole 331 and fluidly isolated from the storage cavity. In this way, a part of the discharge pump 32 is located between the inner plate 22 and the outer plate 21, so that the volume of the detergent dispensing device 3 is reduced. The discharge pump 32 is arranged outside the storage box. In this way, the maintenance of the discharge pump 32 is facilitated. In addition, the upper cover plate 33 can also be provided with a fastening mounting post 332 for mounting other parts.

In this embodiment, the discharge pump 32 is a double discharge pump that quantitatively extracts two detergents from the storage cavity and dispenses the two detergents separately, which can achieve accurate delivery of the two detergents. The present disclosure is not limited to the use of the double discharge pump, and other types of discharge pumps can also be used. For example, the discharge pump 32 can respectively and quantitatively extract two or more detergents from the storage cavity, and dispense the two or more detergents. The discharge pump 32 may be two separate discharge pumps (for example, the discharge pumps shown in FIGS. 36-43B) with separate intake port and separate outlet. In addition, the discharge pump can also initially mix the two detergents and then dispense them. Those skilled in the art can modify and change the discharge pump 32 as required, and can also make appropriate modifications and changes to other features of the present disclosure according to the type of discharge pump 32 used, without going beyond the scope of the present disclosure.

According to the detergent dispensing device 3 of the present embodiment, the detergent is directly dispensed into the main body 1 of the dishwasher, and mixed with washing water, without providing a mixing chamber for mixing the detergent and the washing water. Therefore, the storage box can be placed between the inner plate 22 and the outer plate 21, and the space utilization rate of the dishwasher is improved.

As described above, the pipeline module is provided with a filling cap 36 to close the filling ports 3521 and 3531 of the pipeline module body 35. In the present disclosure, there are two filling ports 3521, 3531 and two filling caps 36 of the pipeline module, which are used to add the detergent into two separate sub storage cavities (a first storage cavity and a second storage cavity) in the storage cavity. The filling caps 36 are each provided with a one-way gas valve 361 which realizes one-way inflow of gas from the outside to the inside of the pipeline module. The gas enters the storage cavity through the pipeline module to make the internal pressure of the storage cavity balanced with the external pressure, so that the suction of the detergent in the storage cavity by the discharge pump 32 is stable and reliable. Specifically, when there is a negative pressure inside the storage cavity (for example, a negative pressure caused by the suction of the detergent in the storage cavity), the one-way air valve 361 can fill in air to reduce negative pressure. In addition, this also prevents the wall surface of the storage box (for example, the wall surface of the upper cover plate 33 or the box body 34) from being deformed due to negative pressure. The one-way gas valve 361 is arranged on the filling cap 36, saving the space of the pipeline module. The filling cap 36 is installed on an exposed portion of the pipeline module. In order to prevent the case in which the detergent in the storage cavity flows out through the one-way valve 361 due to the failure of the latter so that the detergent and a pipeline of the discharge pump 32 are in contact with each other, the cover 31 is employed outside the filling cap 36 with the one-way valve 361 to cover the one-way valve, ensuring the safety of users and effectively reducing potential safety hazards. In some cases, the cover 31 covers the outside of the pipeline module and the discharge pump 32 to liquid-tightly isolate the pipeline module from the discharge pump 32.

In addition, a sealing ring 362 is provided on the filling cap 36 to form a fluid seal between the filling cap 36 and the pipeline module. In addition, the filling cap 36 is provided with a filling cap connecting portion 363, and the pipeline module body 35 is provided with a pipeline module connecting portion 351 at the filling ports 3521, 3531 which cooperates with the filling cap connecting portion 363 to fix the filling cap 36. The sealing ring 362 is above the filling cap connecting portion 363 and is closer to the outside of the pipeline module than the filling cap connecting portion 363. The filling cap 36 can be rotatably plugged into the filling ports 3521 and 3531 of the pipeline module. The filling cap connecting portion 363 generally has a shape of a hook opened in a screw-in circumferential direction, and the filling cap connecting portion 363 is provided with a protrusion 3631. The pipeline module connecting portion 351 is in a shape of a hook that opened in a direction opposite to the screw-in circumferential direction, and the pipeline module connecting portion is provided with a recess 3511. When the filling cap 36 is screwed into the filling port, the filling cap 36 compresses the sealing ring 362, causing the sealing ring 362 to undergo a compression deformation and the filling cap connecting portion 363 to be deformed to make the filling cap connecting portion 363 and the pipeline module connecting portion 351 hooked to each other, the protrusion 3631 being inserted into the recess 3511; under the action of the restoring force of the sealing ring 362, the filling cap 36 is fixed to the filling cap connecting portion 363 to prevent the filling cap 36 from being loosened from the filling port, and the filling cap 36 is tightly connected with the pipeline module. By providing the filling cap connecting portion 363 and the pipeline module connecting portion 351, the filling cap 36 can be fixed without using screw fixing, which effectively reduces cost, and it is convenient to remove the filling cap 36 from the pipeline module manually.

The pipeline module and the upper cover plate 33 may be integrally formed. In this way, the relative position between the pipeline module and the storage box is fixed, avoiding installation position errors caused by the separation of the pipeline module and the storage box from each other. In addition, the one-piece structure reduces the number of molds, reduces mold investment costs, optimizes the overall structure assembly process, and saves labor costs.

The channels in the pipeline module according to the present disclosure will be introduced below with reference to FIGS. 11A-16. As shown in FIGS. 11A-16, the pipeline module body 35 has a first filling port 3521, a second filling port 3531, a first outlet port 3561, a second outlet port 3571, a first inlet port 3541, a second inlet port 3551, a first detergent dispensing port 3562, and a second detergent dispensing port 3572. The pipeline module body 35 also includes a first filling channel 352 connecting the first filling port 3521 and the first storage cavity, and a second filling channel 353 connecting the second filling port 3531 and the second storage cavity, a first inlet channel 354 connecting the first storage cavity and the first inlet port 3541, a second inlet channel 355 connecting the second storage cavity and the second inlet port 3551, and a first outlet channel 356 connecting the first detergent dispensing port 3562 and the first outlet port 3561 and a second outlet channel 357 connecting the second outlet port 3571 and the second detergent dispensing port 3572.

Figure 11A:
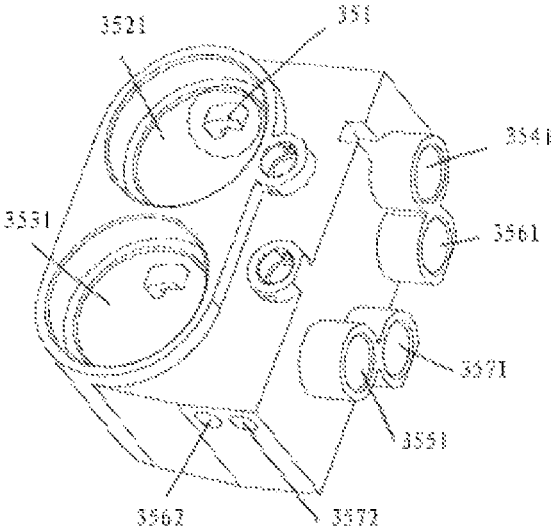
FIG. 11A is a perspective view of a pipeline module according to an embodiment of the present disclosure.
Figure 11B:
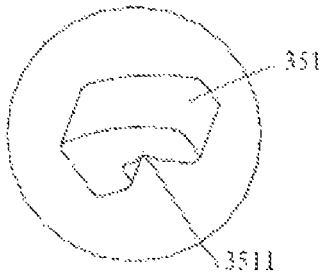
FIG. 11B is a partial enlarged view of the perspective view of the pipeline module in FIG. 11A.
Figure 12:
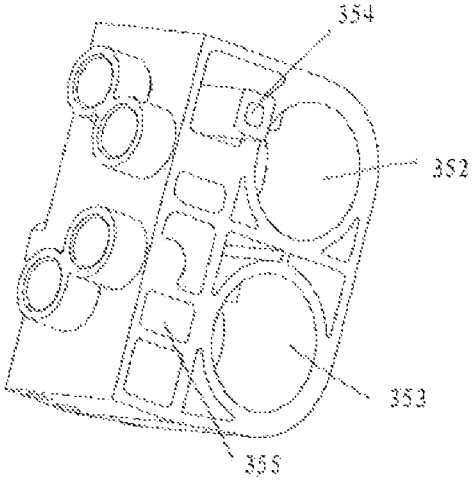
FIG. 12 is another perspective view of a pipeline module according to an embodiment of the present disclosure.
Figure 13:
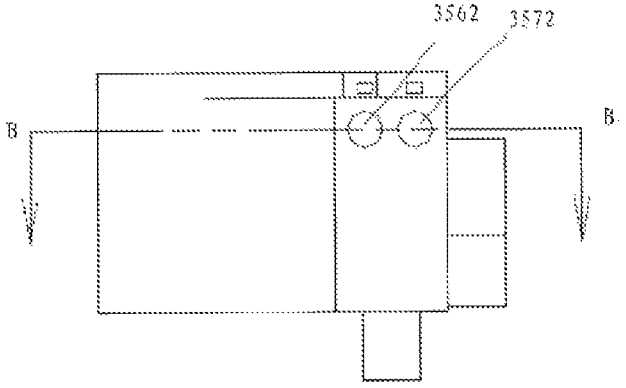
FIG. 13 is a side view of a pipeline module according to an embodiment of the present disclosure.
Figure 14:
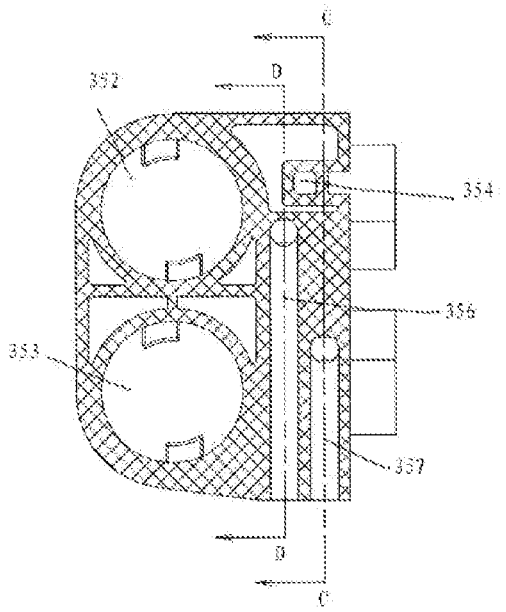
FIG. 14 is a transverse cross-sectional view of the pipeline module according to an embodiment of the present disclosure, taken along the line B-B in FIG. 13.
Figure 15:
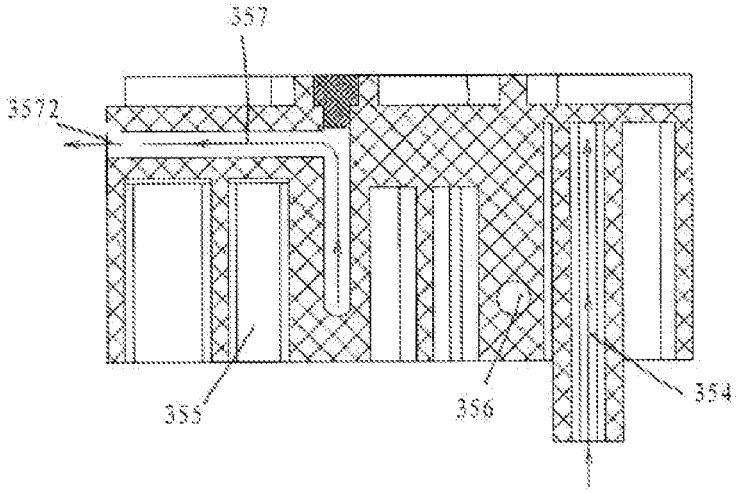
FIG. 15 is a longitudinal cross-sectional view of the pipeline module according to an embodiment of the present disclosure, taken along line C-C in FIG. 14.
Figure 16:
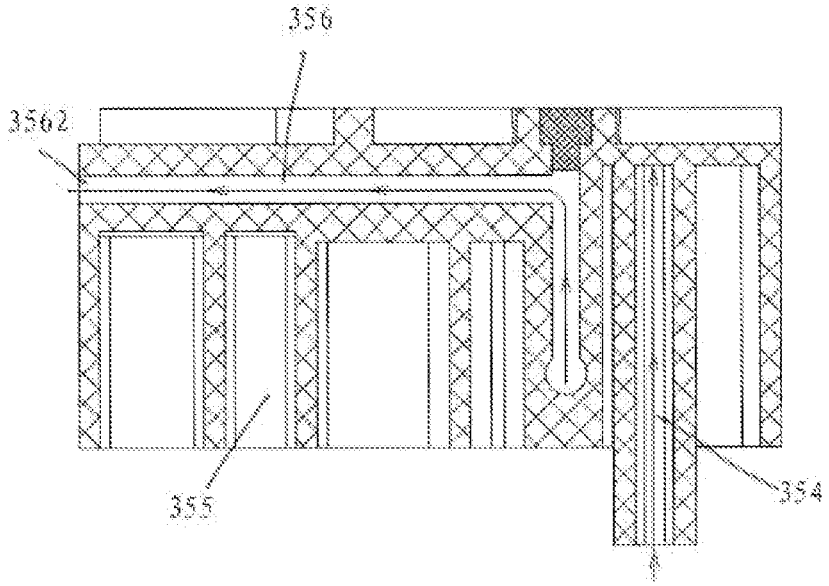
FIG. 16 is a longitudinal sectional view of the pipeline module according to an embodiment of the present disclosure, taken along the line D-D in FIG. 14.

As shown in FIGS. 11A, 12, and 13, one ends of the first filling channel 352 and of the second filling channel 353 are the first filling port 3521 and the second filling port 3531, which are respectively in communication with the outside and covered by the filling caps 36. The other ends of the first filling channel 352 and of the second filling channel 353 are respectively communicated with the first storage cavity and the second storage cavity of the storage box, and specifically opened to a first chamber 341 and a third chamber 343. As shown in FIGS. 11A, 12, and 14-16, one ends of the first inlet channel 354 and of the second inlet channel 355 are the first inlet port 3541 and the second inlet port 3551 of the pipeline module, respectively, and connected to the first intake port and the second intake port of the discharge pump, respectively; the other ends of the first inlet channel 354 and of the second inlet channel 355 are respectively communicated with the first storage cavity and the second storage cavity, specifically opened to the second chamber 342 and the second inlet cavity 3412. As shown in FIGS. 11A and 12-16, one ends of the first outlet channel 356 and of the second outlet channel 357 are the first outlet port 3561 and the second outlet port 3571 of the pipeline module, respectively and are connected to the first outlet and the second outlet of the discharge pump, respectively; the other ends of the first outlet channel 356 and of the second outlet channel 357 are the first detergent dispensing port 3562 and the second detergent dispensing port 3572 respectively and are respectively opened to the inside of the main body 1 to dispense detergent into the inside of the main body 1.

In this case, the double discharge pump 32 sucks the first detergent from the first storage cavity through the first inlet channel 354 and discharges the first detergent into the main body 1 of the dishwasher via the first outlet channel 356 (i.e., the outside of the detergent dispensing device 3), and sucks the second detergent from the second storage cavity through the second inlet channel 355 and discharges the second detergent into the main body 1 of the dishwasher via the second outlet channel 357.

When the door 2 is in the closed position, the first detergent dispensing port 3562 and the second detergent dispensing port 3572 are exposed to the main body 1 of the dishwasher and open vertically downward, so that the detergents flowing out of the first detergent dispensing port 3562 and the second detergent dispensing port 3572 drops vertically. The cover 31 as described above has an opening through which the first detergent dispensing port 3562 and the second detergent dispensing port 3572 are exposed to the outside. Preferably, the first detergent dispensing port 3562 and the second detergent dispensing port 3572 are located at the same level to facilitate observation during liquid dispensing. The washing water in the main body 1 can flush the sagging detergent at the first detergent dispensing port 3562 and the second detergent dispensing port 3572 to remove the sagging detergent. The pipeline module has a simple structure, which simplifies liquid circulation path and the structure for liquid circulation, and reduces the cost.

The storage box according to the present disclosure will be introduced with reference to FIGS. 17-19B.

Figure 17:
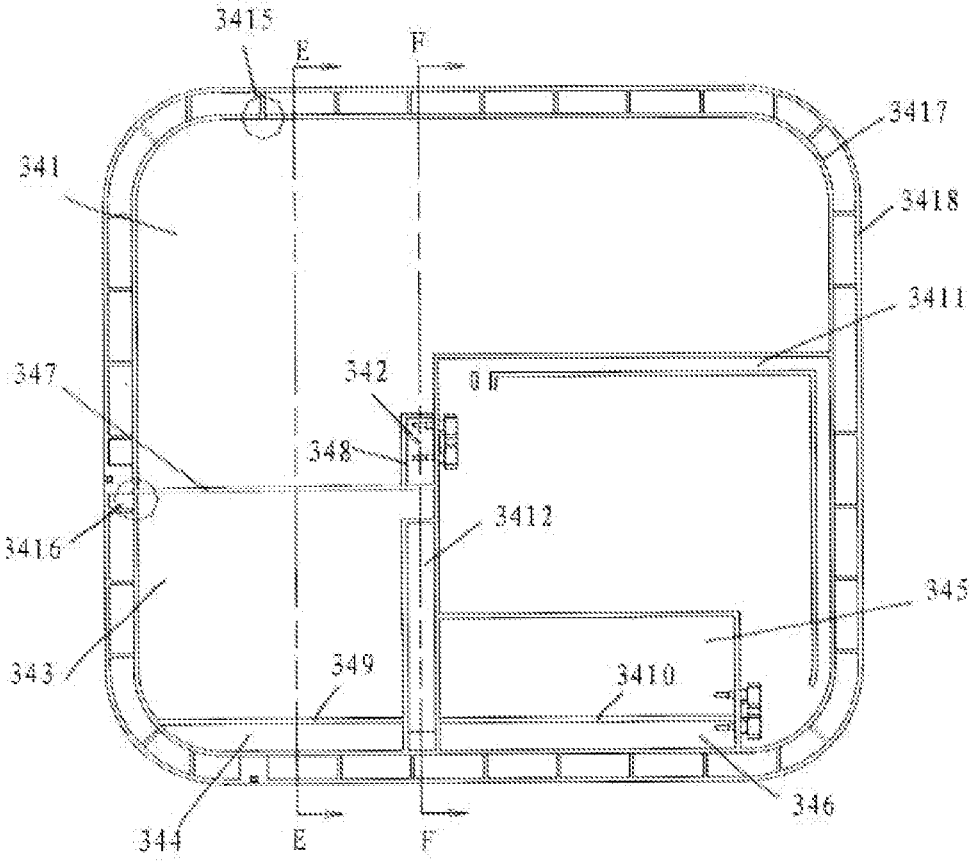
FIG. 17 is a top view of a box body of a storage box according to an embodiment of the present disclosure.
Figure 18A:
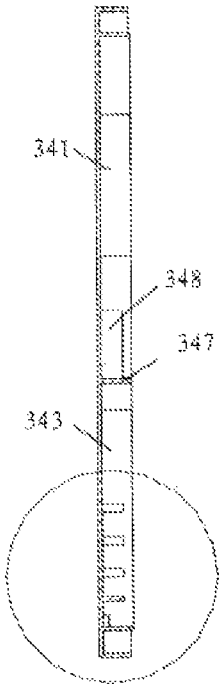
FIG. 18A is a cross-sectional view of the box body of the storage box according to an embodiment of the present disclosure, taken along the line E-E in FIG. 17.
Figure 18B:
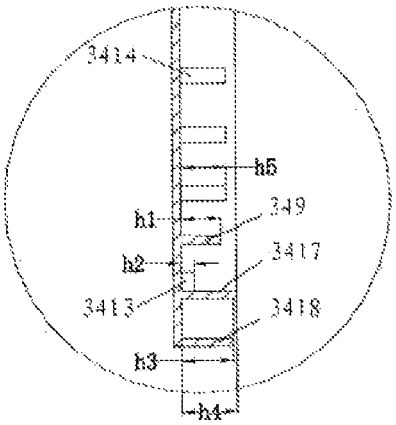
FIG. 18B is a partial enlarged view of the cross-sectional view of the box body of the storage box in FIG. 18A.
Figure 19A:
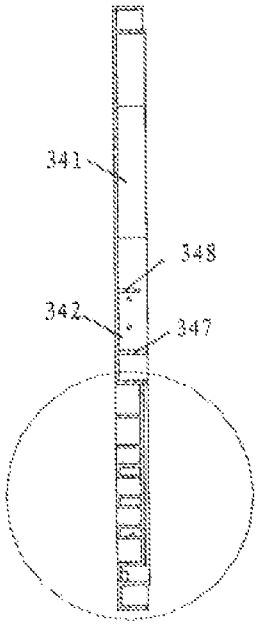
FIG. 19A is a cross-sectional view of the box body of the storage box according to an embodiment of the present disclosure, taken along the line F-F in FIG. 17.
Figure 19B:
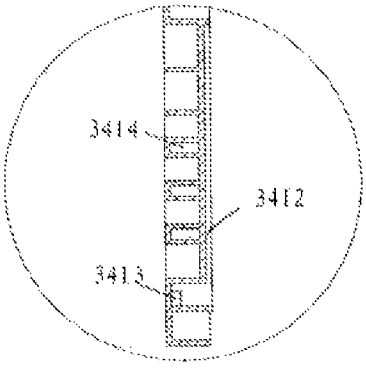
FIG. 19B is a partial enlarged view of the cross-sectional view of the box body of the storage box in FIG. 19A.

As shown in FIG. 17, the storage cavity of the box body 34 includes a first storage cavity, a second storage cavity, and a second inlet cavity 3412. The first storage cavity is used to contain the first detergent, and includes a first chamber 341 and a second chamber 342. The second storage cavity is used to contain the second detergent, and includes a third chamber 343, a fourth chamber 344, a fifth chamber 345, and a sixth chamber 346. The first detergent and the second detergent may be the same or different as needed.

The size of each chamber in the first storage cavity and the second storage cavity can be determined according to actual needs. The arrangement of the fifth chamber 345 and the sixth chamber 346 makes the storage space in the box body 34 (or the space between the inner plate 22 and the outer plate 21 of the door 2) fully utilized.

The first filling port 3521 and the second filling port 3531 are used for adding liquid to the first storage cavity and the second storage cavity, respectively. Specifically, the first filling port 3521 opens to the first chamber 341, and the second filling port 3531 opens to the third chamber 343. More specifically, the first filling port 3521 may be located above the first chamber 341, and the second filling port 3531 may be located above the third chamber 343, so that the detergents added through the first filling port 3521 and the second filling port 3531 are directed into the first chamber 341 and the third chamber 343 via the first filling channel 352 and the second filling channel 353 using gravity.

The detergent dispensing device 3 is mounted to the door 2 such that the bottom installation side of the detergent dispensing device is close to the rotation axis of the door 2. The box body 34 of the detergent dispensing device 3 includes a bottom wall and four side walls, and the normal direction of the bottom wall is parallel to a first direction. An intermediate partition 347, a first partition 348, a second partition 349, and a third partition 3410 protrude from the bottom wall.

As shown in FIGS. 18A-19B, the intermediate partition 347 is configured to separate the first storage cavity, the second storage cavity, and the second inlet cavity 3412 from each other, so that the first storage cavity, the second storage cavity and the second inlet cavity 3412 are not in fluid communication with each other. The first partition 348 is configured to separate the first chamber 341 and the second chamber 342, and the first chamber 341 and the second chamber 342 are in communication through a gap between the first partition 348 and the upper cover plate 33. The second chamber 342 is closer to the rotation axis of the door 2 (i.e., closer to the bottom installation side) than the first chamber 341. As shown in FIG. 17, the fact that the second chamber 342 is closer to the rotation axis of the door 2 than the first chamber 341 does not mean that any part of the second chamber 342 is closer to the rotation axis of the door 2 than any part of the first chamber 341, instead, as long as the whole of the second chamber 342 is closer to the rotation axis of the door 2 than the whole of the first chamber 341, when the door 2 is switched to the closed position, the remaining first detergent can be at least partially retained in the second chamber 342 due to the relative position between the first chamber 341 and the second chamber 342. Therefore, it is possible to allow the other end of the first inlet channel 354 to be always submerged by the first detergent, and to compare the amount of the first detergent in the second chamber 342 with a predetermined amount, regardless of whether the door 2 is in the horizontal position or the vertical position.

The second partition 349 is configured to separate the third chamber 343 and the fourth chamber 344, and the third chamber 343 and the fourth chamber 344 are communicated through a gap between the second partition 349 and the upper cover plate 33. The third partition 3410 is configured to separate the fifth chamber 345 and the sixth chamber 346, and the fifth chamber 345 and the sixth chamber 346 are communicated through a gap between the third partition 3410 and the upper cover plate 33. In this embodiment, the first partition 348, the second partition 349, and the third partition 3410 extend from the bottom of the storage box toward the upper cover plate 33, but do not touch the upper cover plate 33. In addition, the third chamber 343 and the fifth chamber 345 are in communication with each other through a through hole 3414, and the fourth chamber 344 and the sixth chamber 346 are both in communication with the second inlet cavity 3412 through a second inlet guiding hole 3413. In addition, the fourth chamber 344 is closer to the rotation axis of the door 2 (i.e., closer to the bottom installation side) than the third chamber 343, and the sixth chamber 346 is closer to the rotation axis of the door 2 (i.e., closer to the bottom installation side) than the fifth chamber 345. Here, similar to the first chamber 341 and the second chamber 342, the fact that the fourth chamber 344 or the sixth chamber 346 is closer to the rotation axis of the door 2 than the corresponding third chamber 343 or fifth chamber 345 does not mean that any part thereof is closer to the rotation axis of the door 2 than any part of the third chamber 343 or the fifth chamber 345.

In addition, as shown in FIG. 17, the storage box may also include a pump accommodating space for at least partially accommodating the discharge pump 32 and a lead groove 3411 located in the discharge pump accommodating space. The position of the pump accommodating space is substantially corresponding to that of the avoiding hole 331 described above, and wires can be placed in the lead groove 3411. The pump accommodating space is fluidly separated from the storage cavity. In the embodiment shown in FIG. 17, another intermediate partition 347 is provided to separate the first storage cavity, the second storage cavity, and the second inlet cavity from the pump accommodating space, respectively.

The following describes the process of adding detergent to the dishwasher for the first time.

When the door 2 of the dishwasher is in the open position, the storage box is placed horizontally, and the user can add detergents to the first storage cavity and the second storage cavity through the first filling port 3521 and the second filling port 3531 respectively. Specifically, the user can directly add detergents to the first chamber 341 and the third chamber 343 through the first filling port 3521 and the second filling port 3531 respectively.

When the first detergent is added to the first chamber 341 through the first filling port 3521 to a height higher than the first partition 348, the first detergent flows over the first partition 348 into the second chamber 342. In addition, air in the second chamber 342 can be discharged through the first chamber 341 and the one-way air valve 361. The volume of the second chamber 342 is smaller than the volume of the first chamber 341, for example, less than one-fifth of the volume of the first chamber 341.

A first liquid level sensor may be arranged in the first storage cavity for measuring liquid level in the first storage cavity, and a second liquid level sensor may be arranged in the second storage cavity for measuring liquid level in the second storage cavity.

The first liquid level sensor can measure liquid level in the first storage cavity when the door 2 is placed horizontally, and its sensing part can be installed in the second chamber 342. It is advisable to add the first detergent until it completely immerses the first liquid level sensor. Alternatively, it is advisable to add the first detergent below the tubular module connecting portion 351.

When the second detergent is added to the third chamber 343, the second detergent flows into the fifth chamber 345 through the through hole 3414, and air in the fifth chamber 345 enters the third chamber 343 through the through hole 3414 to be discharged. When the second detergent is added to the third chamber 343 via the first filling port 3521 to a height h1 higher than the height of the second partition 349, the second detergent flows over the second partition 349 into the fourth chamber 344, air in the fourth chamber 344 being discharged through the third chamber 343. In addition, when the second detergent is added to the fifth chamber 345 to a height higher than the height of the third partition 3410, the second detergent flows over the third partition 3410 into the sixth chamber 346, and air in the sixth chamber 346 is discharged through the fifth chamber 345 and the third chamber 343. The height h1 of the second partition 349 may be the same as the height of the third partition 3410. In addition, the detergent can also flow into the second inlet cavity 3412 from the fifth chamber 345 and the sixth chamber 346 through the second inlet guiding hole 3413. The height h2 of the second inlet guiding hole 3413 is smaller than the height h1 of the second partition 349 and the height of the third partition 3410.

The height h5 of the through hole 3414 is not lower than the height h1 of the second partition 349 and the height of the third partition 3410, so that the second detergent passes over the second partition 349 and the third partition 3410 to fill respectively the fifth chamber 345 and sixth chamber 346. Until the detergent liquid level is flush with the through hole 3414, the second detergent is no longer injected into the fifth chamber 345 and the sixth chamber 346.

The second liquid level sensor can measure the liquid level in the second storage cavity when the door 2 is placed horizontally, and its sensing part can be installed in the sixth chamber 346. It is advisable to add the second detergent until it completely immerses the second liquid level sensor. Alternatively, it is advisable to add the second detergent below the tubular module connecting portion 351.

The following describes the process of dispensing detergents into the dishwasher for the first time.

When the door 2 of the dishwasher is in the closed position, the storage box is placed vertically. Under the action of gravity, the first detergent enters the second chamber 342 from the first chamber 341, the second detergent enters the fourth chamber 344 from the third chamber 343, and enters the sixth chamber 346 from the fifth chamber 345. When the detergent is dispensed for the first time, there is air in the second inlet cavity 3412. Therefore, it is necessary to discharge the air before the second detergent is dispensed therein, for example, in a quantitative manner. In addition, there may be air in the second chamber 342. After the air is discharged, the first detergent may be dispensed therein, for example, in a quantitative manner.

When the dishwasher works for several cycles, the solution in the storage box will gradually decrease. The first liquid level sensor can sense the first detergent liquid level in the first storage cavity when the door 2 is placed vertically, or another liquid level sensor can be additionally provided to realize this sensing. The second liquid level sensor can sense the liquid level in the second storage cavity when the door 2 is placed vertically, or another liquid level sensor can be additionally provided to realize this sensing. When the liquid level is lower than the predetermined liquid level, the dishwasher can notify the user of the need to add detergents through a notification device. The notification device is, for example, a display screen, a speaker, and the like. The above-mentioned liquid level sensor can be a probe type sensor in whole or in part, which is small in size and saves space.

The second inlet guiding hole 3413 makes the fourth chamber 344 and the sixth chamber 346 communicated with the second inlet cavity 3412 respectively at locations of the fourth chamber 344 and the sixth chamber 346 close to the rotation axis. Therefore, the second inlet guiding hole 3413 can always be submerged by the second detergent, so that air cannot flow into the second inlet cavity 3412, and the second detergent in the second inlet cavity 3412 cannot flow out.

The process of adding detergent to the detergent dispensing device 3 once again is described below.

The door 2 switches from the closed position to the open position. The above-mentioned predetermined liquid level is set such that after the door 2 is switched to the open position, the other end of the first inlet channel 354 is still immersed in the first detergent, since the second chamber 342 is closer to the rotation axis of the door 2 than the first chamber 341 and thus still retains part of the first detergent therein. This part of the first detergent plays a role of sealing the other end of the first inlet channel 354.

Similarly, the predetermined value of the above-mentioned liquid level is set such that after the door 2 is switched to the open position, the second inlet guiding hole 3413 is immersed in the second detergent, since the fourth chamber 344 and the sixth chamber 346 are respectively closer to the pivot axis of the door 2 than the third chamber 343 and the fifth chamber 345 and thus still retain part of the second detergent therein respectively. This part of the second detergent plays a role of sealing the second inlet guiding hole 3413. Therefore, the second inlet cavity 3412 is still filled with the second detergent without air flowing into it.

As described above, the first detergent and the second detergent are respectively added into the first storage cavity and the second storage cavity via the first filling port 3521 and the second filling port 3531.

Since the other end of the first inlet channel 354 is still immersed in the first detergent and the second inlet cavity 3412 is still filled with the second detergent without air flowing into it, there is basically no need to discharge air during detergent dispensing process following the adding of the detergent once again. Therefore, the working efficiency of the discharge pump is improved, and the proportion of output quantities of various detergents is more accurate.

As shown in FIG. 17, the box body 34 of the storage box may also be provided with a first vent 3415 communicating the first cavity with outside and a second vent 3416 communicating the second cavity with outside. The first vent 3415 and the second vent 3416 are always higher than the detergent liquid level, regardless of whether the door 2 is in the open position or the closed position. In this way, the first vent 3415 and the second vent 3416 are beneficial to achieve a balance between pressure in the storage cavity and ambient pressure. In addition, the first vent 3415 and the second vent 3416 may also be provided with a one-way valve.

Figure 20A:
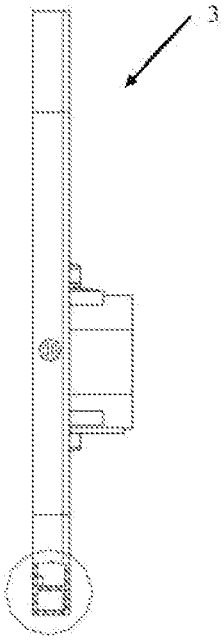
FIG. 20A is another side view of the detergent dispensing device according to an embodiment of the present disclosure, in which a part of the detergent dispensing device is cut away.
Figure 20B:
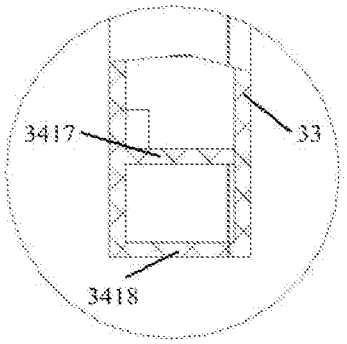
FIG. 20B is a partial enlarged view of a cutaway view of a part of the detergent dispensing device in FIG. 20A.

As shown in FIGS. 17, 20A, and 20B, the box body 34 of the storage box has an inner side panel 3417 surrounding the outer peripheral of the box body 34 and an outer side panel 3418. The inner side panel 3417 is located inside the outer side panel 3418. The inner side panel 3417 and the intermediate partition 347 surround and seal the storage cavity. When the box body 34 and the upper cover plate 33 of the storage box are welded by hot plate (hot plate welding mainly relies on heating two materials that are to be welded to each other to achieve the melting state of the materials, and then applying a certain pressure to achieve mutual welding), the welding causes the inner side panel 3417 and the upper cover plate 33 to produce flash, which is detrimental to the aesthetics. The height h4 of the inner side panel 3417 is higher than the height h3 of the outer side panel 3418. The upper cover plate 33 is provided with a boss protruding toward the outer side panel 3418 at a position corresponding to the outer side panel 3418, and an end face of the outer side panel 3418 abuts against an end face of the boss to prevent the flash from being observed and to make an outer peripheral wall surface of the outer side panel 3418 flat, and thus improving the aesthetics of the detergent dispensing device 3.

In some embodiments, the storage box is further provided with a first drain port located in the first storage cavity and a second drain port located in the second storage cavity, so as to facilitate cleaning the storage cavity or discharge of liquid or residue in the storage cavity when replacing detergent. The first drain port and the second drain port are both at a bottom end of the storage cavity (when the storage box is in the open position, or when the storage box is in the closed position), thus when a user needs to clean the first storage cavity and the second storage cavity, or when a user wants to replace the detergent, the first drain port and the second drain port are opened to drain remaining liquid. Therefore, it is convenient for a user to clean the storage cavity and replace other solutions, and at the same time, normal working performance of the discharge pump 32 can be ensured.

A connecting wire of the liquid level sensor and a connecting wire of the discharge pump 32 may be connected to outside via a lead groove 3411. The connection wire of the liquid level sensor and the connection wire of the discharge pump 32 may be formed into two bundles or may be combined into one bundle. In this way, the use of plastic shells as well as cost can be reduced.

The detergent dispensing device 100 according to another embodiment of the present disclosure is described in detail below, which may be installed in the door 2 of the dishwasher.

Figure 21:
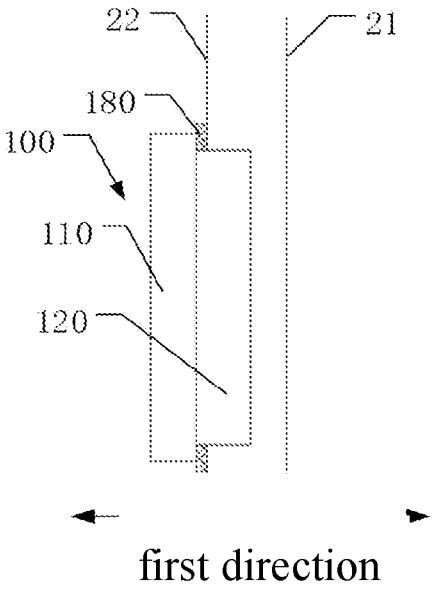
FIG. 21 shows a part of a detergent dispensing device and a door of a dishwasher according to an embodiment of the present disclosure.

FIG. 21 shows a part of a detergent dispensing device 100 and a door 2 of a dishwasher including the detergent dispensing device 100 according to an embodiment of the present disclosure. As shown in FIG. 21, the detergent dispensing device 100 may be installed in the door 2.

Figure 22:
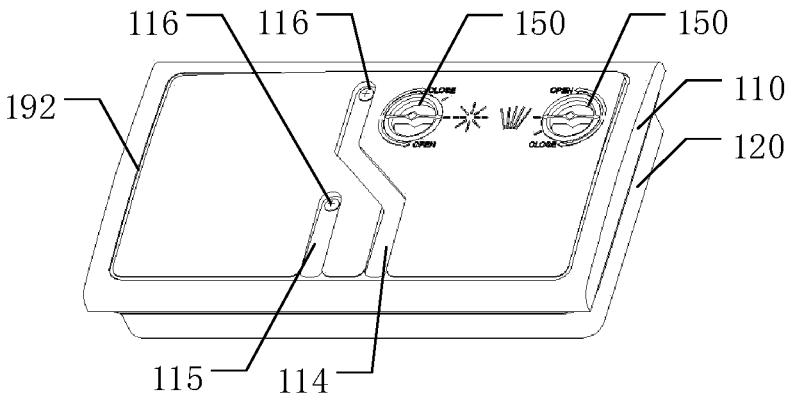
FIG. 22 shows a perspective view of a detergent dispensing device according to an embodiment of the present disclosure.
Figure 24:
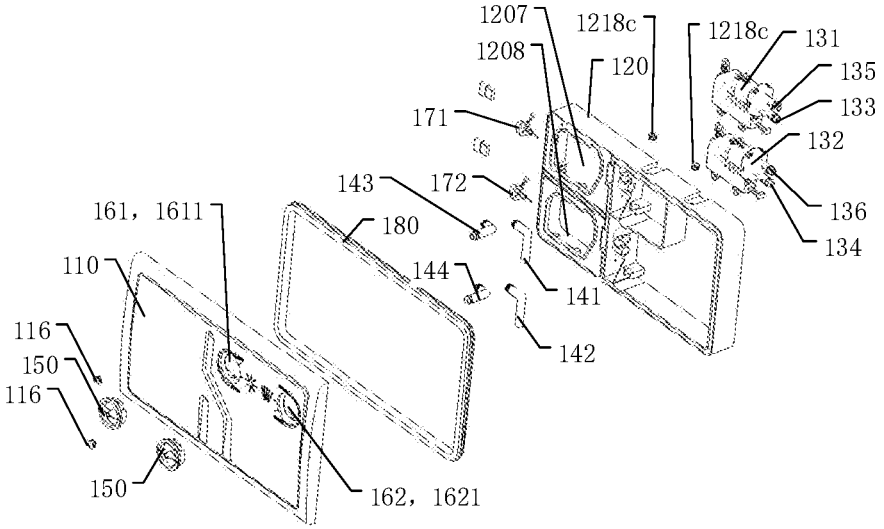
FIGS. 24 and 25 show respectively an exploded perspective view of the detergent dispensing device shown in FIG. 22 viewed from different angles.
Figure 25:
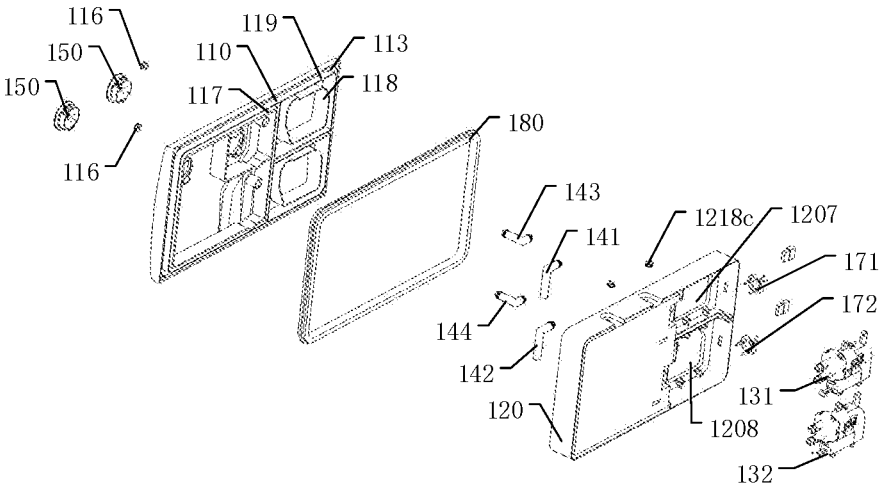

FIG. 22 shows a perspective view of the detergent dispensing device 100 according to an embodiment of the present disclosure. FIGS. 23A-23F show respectively a front view, a rear view, a right side view, a left side view, a top view and a bottom view of the detergent dispensing device 100 shown in FIG. 22. FIGS. 24 and 25 show respectively an exploded perspective view of the detergent dispensing device 100 shown in FIG. 22 viewed from different angles.

As shown in FIGS. 21-25, at least one embodiment of the present disclosure provides a detergent dispensing device 100 for a dishwasher, which includes a storage box, a discharge pump, and a pipeline module. The storage box includes a first half shell 110 and a second half shell 120 fixedly connected to each other in a first direction to define a storage cavity for storing detergent as well as a sealing washer 180. The second half shell 120 defines pump accommodating spaces 1207, 1208 for accommodating at least a part of the discharge pump. For example, the first half shell 110 and the second half shell 120 are connected by welding or bonding.

As shown in FIG. 21, most of the second half shell 120 is accommodated between the inner plate 22 and the outer plate 21 of the door 2. The first half shell 110 is joined to the second half shell 120 from the side where the inner plate 22 is located, and the sealing washer 180 is sandwiched between the first half shell 110 and the inner plate 22.

Figure 26A:
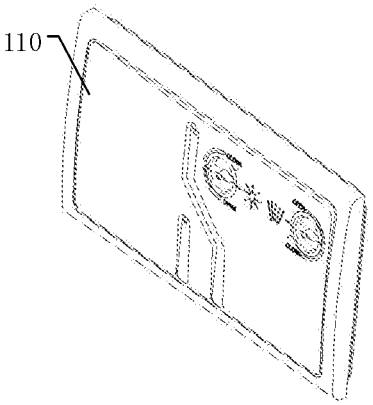
FIGS. 26A and 26B show respectively a perspective view of the first half shell of the detergent dispensing device shown in FIG. 22.
Figure 26B:
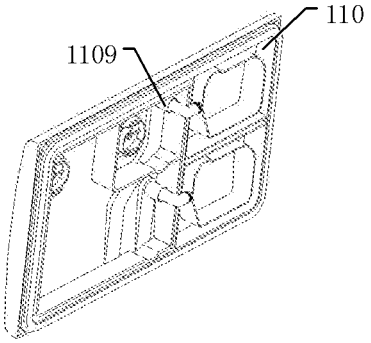

FIGS. 26A and 26B show respectively a perspective view of the first half shell 110 of the detergent dispensing device 100 shown in FIG. 22. As shown in FIGS. 25, 26A and 26B, the first half shell 110 has an annular groove 113 surrounding the outer periphery of the first half shell 110, and a part of an annular sealing washer 180 is disposed in the annular groove 113.

Figure 27A:
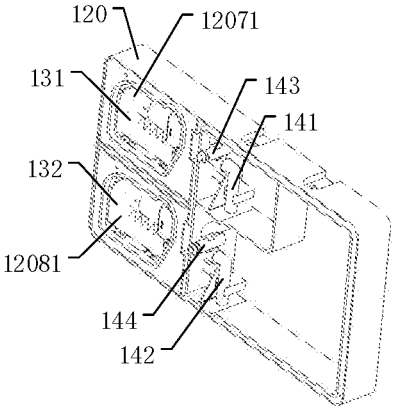
FIGS. 27A and 27B show respectively a perspective view of the detergent dispensing device shown in FIG. 22, in which the first half shell is removed.
Figure 27B:
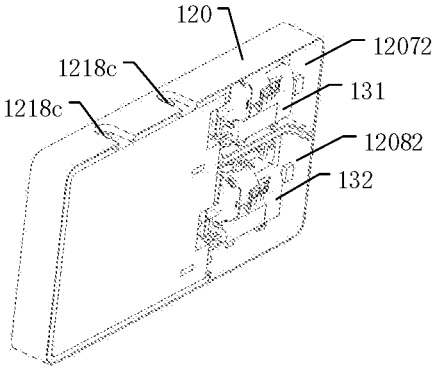
Figure 28A:
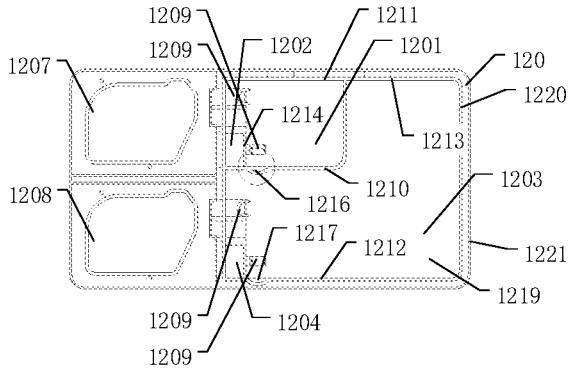
FIG. 28A shows a plan view of the second half shell of the detergent dispensing device shown in FIG. 22.
Figure 28B:
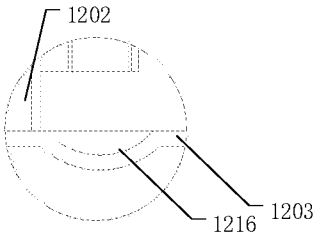
FIG. 28B shows an enlarged view of the circled part in FIG. 28A.
Figure 29A:
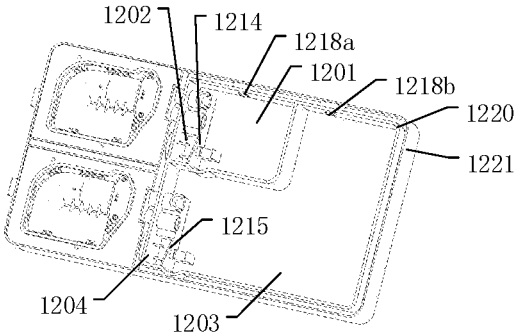
FIG. 29A shows another perspective view of the detergent dispensing device shown in FIG. 22 with the first half shell removed.
Figure 29B:
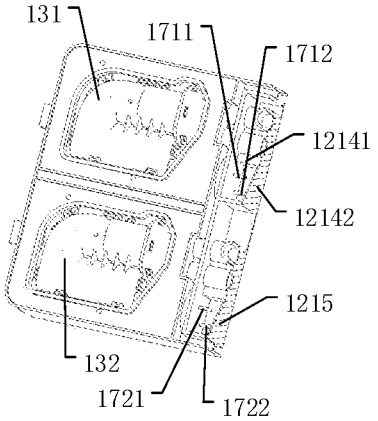
FIG. 29B shows a cross-sectional perspective view of the detergent dispensing device in FIG. 29A.

FIGS. 27A and 27B show respectively a perspective view of the detergent dispensing device 100 shown in FIG. 22, in which the first half shell 110 is removed. FIG. 28A shows a plan view of the second half shell 120 of the detergent dispensing device 100 shown in FIG. 22. FIG. 28B shows an enlarged view of the circled part in FIG. 28A. FIG. 29A shows another perspective view of the detergent dispensing device 100 shown in FIG. 22 with the first half shell 110 removed. FIG. 29B shows a cross-sectional perspective view of the detergent dispensing device 100 in FIG. 29A.

As shown in FIGS. 23-29B, in this embodiment, the storage cavity includes a first storage cavity for storing a first detergent and a second storage cavity for storing a second detergent, and the discharge pump includes a first discharge pump 131 and a second discharge pump 132 which are separately provided. The first discharge pump 131 is configured to suck a first detergent from the first storage cavity and to dispense the first detergent to the outside of the detergent dispensing device (i.e., inside of the dishwasher). The second discharge pump 132 is configured to suck a second detergent from the second storage cavity and to dispense the second detergent to the outside of the detergent dispensing device. The pipeline module includes a first inlet tube 141, a second inlet tube 142, a first outlet tube 143, and a second outlet tube 144.

For example, the first detergent may be a dishwashing agent, which may be a rinse agent. Or, for example, the first detergent may be a rinse agent, and the second detergent may be a dishwashing agent. The first detergent and the second detergent may be the same or different as needed.

The first inlet tube 141 has a first inlet channel extending through it for drawing the first detergent from the first storage cavity by the first discharge pump 131. One end of the first inlet channel is connected with a first intake port 133 of the first discharge pump 131, and the other end is connected with the first storage cavity. The second inlet tube 142 has a second inlet channel extending through it for drawing the second detergent from the second storage cavity by the second discharge pump 132. One end of the second inlet channel is connected with a second intake port 134 of the second discharge pump 132, and the other end is connected with the second storage cavity. The first outlet tube 143 has a first outlet channel extending through it for dispensing the first detergent by the first discharge pump 131. One end of the first outlet channel is connected to the first outlet 135 of the first discharge pump 131, and the other end is connected to the outside of the detergent dispensing device 100. The second outlet tube 144 has a second outlet channel extending through it for dispensing the second detergent by the second discharge pump 132. One end of the second outlet channel is connected with the second outlet 136 of the second discharge pump 132, and the other end is connected with the outside of the detergent dispensing device 100.

The first inlet tube 141, the second inlet tube 142, the first outlet tube 143 and the second outlet tube 144 are each a separate integrated piece, instead of being formed by welding the first half shell 110 and the second half shell 120. Thus product consistency is achieved without being affected by any welding process. For example, the cross section of the first inlet tube 141, the second inlet tube 142, the first outlet tube 143 or the second outlet tube 144 may be circular, so that wetted perimeter is small and therefore liquid resistance is small. For example, the first inlet tube 141, the second inlet tube 142, the first outlet tube 143, or the second outlet tube 144 are rigid, and therefore have a stable structure and small deformation, which is beneficial to improve flow stability.

In other embodiments, the storage cavity may also have only one single storage cavity or may have three or more separate storage cavities as required. The number of components such as the inlet channels 141, 142, the outlet channels 143, 144, and the filling channels 161, 162 (to be described later) can be set according to actual needs.

In other embodiments, one or more of the inlet channels 141, 142, the outlet channels 143, 144, and the filling channels 161, 162 may be included in an integral part instead of being separate integral parts.

In this embodiment, separate first discharge pump 131 and second discharge pump 132 are used to suck and dispense the first detergent and the second detergent. In other embodiments, a single discharge pump combining functions of the first discharge pump 131 and the second discharge pump 132 may be used.

As shown in FIGS. 26B, 28A and 29A clearly, the first half shell 110 and the second half shell 120 are provided with a plurality of tube mounting portions 1109, 1209, to which the first inlet tube 141, the second inlet tube 142, the first outlet tube 143, and the second outlet tube 144 are mounted by means of plugging and snapping. Therefore, the assembly of the detergent dispensing device 100 is simplified.

In this embodiment, the first half shell 110 and the second half shell 120 are respectively an integral piece, the first half shell 110 and the second half shell 120 define an internal space in which the storage cavity and the pump accommodating spaces 1207, 1208 are included. The first inlet tube 141, the second inlet tube 142, the first outlet tube 143, and the second outlet tube 144 are installed in the internal space.

As clearly shown in FIGS. 24-25, 27A, and 27B, the pump accommodating spaces 1207, 1208 of the second half shell 120 include a first pump accommodating space 1207 receiving the first discharge pump 131 and a second pump accommodating space 1208 receiving the second discharge pump 132.

A first opening 12071, 12081 close to the first half shell 110 and a second opening 12072, 12082 away from the first half shell 110 are provided at both ends of each of the first pump accommodating space 1207 and the second pump accommodating space 1208 of the second half shell 120 in the first direction, to allow at least corresponding parts of the discharge pumps 131, 132 to protrude from the first openings 12071, 12081 and the second openings 12072, 12082.

Therefore, the discharge pumps 131, 132 are at least partially uncovered by the shell of the storage box (i.e., the second half shell 120) in the first direction. Therefore, the thickness of the detergent dispensing device 100 in the first direction is further reduced.

In addition, since the pump accommodating space 1207 has the first opening 12071, 12081 and the second opening 12072, 12082, the same storage box may allow the installation of discharge pumps 131, 132 with different heights. Therefore, the space utilization efficiency of the discharge pumps 131 and 132 in the storage box is improved.

For example, when the volume of the discharge pumps 131, 132 is small, the discharge pumps 131, 132 may not protrude from the corresponding first openings 12071, 12081 or the second openings 12072, 12082. For example, the discharge pumps 131, 132 may protrude from the corresponding first openings 12071, 12081 or the second openings 12072, 12082. For example, in this embodiment, the first discharge pump 131 and the second discharge pump 132 extend respectively from the corresponding first openings 12071, 12081 to extend into the first half shell 110.

In this embodiment, the contours of the second openings 12072, 12082 are larger than the contours of the corresponding discharge pumps 131, 132, so that the discharge pumps 131, 132 can be detachably fixed to the second half shell 120 from the second openings 12072, 12082. Therefore, when the discharge pumps 131, 132 need to be replaced or repaired, the discharge pumps 131, 132 can be easily removed from the detergent dispensing device 100 without replacing the entire detergent dispensing device 100. Therefore, maintenance costs are reduced.

Figure 30A:
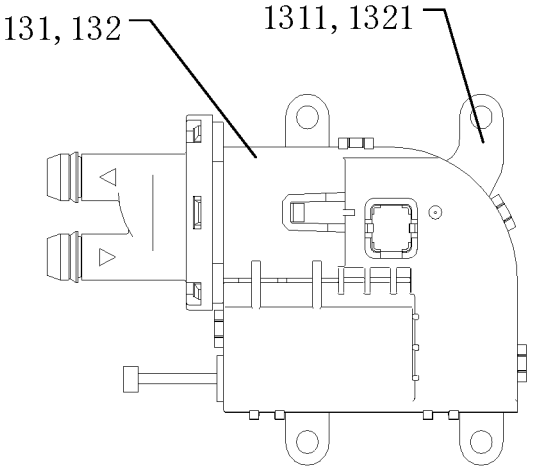
FIGS. 30A and 30B show plan views of a discharge pump according to an embodiment of the present disclosure.
Figure 30B:
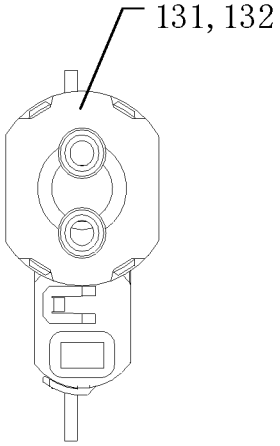

FIGS. 30A and 30B show plan views of a discharge pump 131, 132 according to an embodiment of the present disclosure. The discharge pumps 131, 132 have mounting arms 1311, 1321 that can be fixed to the second half shell 120 by, for example, threaded connections, so that the discharge pumps 131, 132 can be fixedly mounted to the second half shell 120. In addition, the discharge pumps can also be mounted to the second half shell 120 through other methods such as a snap structure.

For example, in this embodiment, the discharge pumps 131, 132 include a DC motor, and a Hall sensor for measuring the rotation angle of the DC motor. In the case of the same power, DC motors have a smaller volume than other types of motors such as stepper motors. The Hall sensor is used to control the rotation angle of an output shaft of the DC motor, thereby controlling the amount of detergent.

Therefore, the volume of the discharge pumps 131, 132 can be reduced while accurately controlling the dispensing amount of detergent.

As shown in FIG. 22, FIG. 26A and FIG. 26B, an outer side of the first half shell 110 opposite to the second half shell 120 is provided with a first detergent guiding groove 114 and a second detergent guiding groove 115 recessed in the first direction. The other end of the first outlet channel is opened to the first detergent guiding groove 114 and the other end of the second outlet channel is opened to the second detergent guiding groove 115.

The first discharge pump 131 draws the first detergent from the first storage cavity through the first inlet channel, and then pumps the first detergent to an opening at the other end of the first outlet channel through the first outlet channel. Since the first detergent guiding groove 114 is provided, the first detergent falls along the first detergent guiding groove 114 into the interior of the dishwasher.

The second discharge pump 132 draws the second detergent from the second storage cavity through the second inlet channel, and then pumps the second detergent to an opening at the other end of the second outlet channel through the second outlet channel. Since the second detergent guiding groove 115 is provided, the second detergent falls along the second detergent guiding groove 115 into the interior of the dishwasher.

In addition, the first detergent guiding groove 114 and the second detergent guiding groove 115 also help to improve the structural strength and aesthetics of the first half shell 110.

In addition, for example, the opening at the other end of the first outlet channel and the opening at the other end of the second outlet channel are both provided with a second one-way valve 116. The second one-way valve 116 conducts fluid unidirectionally in a direction from inside of the storage cavity to outside of the storage cavity. The fluid can be gas and liquid. The second one-way valve 116 can allow corresponding detergent to be pumped from the inside of corresponding storage cavity to outside, and at the same time can block water vapor inside the dishwasher from entering the discharge pumps 131, 132, thereby avoiding the influence of water vapor on the performance and life of the discharge pumps 131, 132.

As shown in FIG. 23E, FIG. 27A, FIG. 27B, FIG. 29A, the second half shell 120 is provided with a first air inlet 1218*a* and a second air inlet 1218*b* which are respectively used to allow air outside the detergent dispensing device 100 to enter the first storage cavity and the second storage cavity. The first air inlet 1218*a* and the second air inlet 1218*b* are each provided with a third one-way valve 1218*c*. The third one-way valve 1218*c* is configured to allow gas to enter the detergent dispensing device 100 from outside thereof, while preventing corresponding detergent from flowing from the storage cavity of the detergent dispensing device 100 to outside of the detergent dispensing device 100.

Figure 31A:
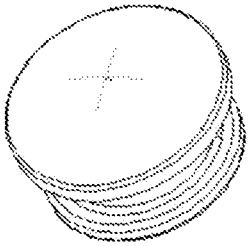
FIGS. 31A-31B show schematic views of a second one-way valve and a third one-way valve according to an embodiment of the present disclosure.
Figure 31B:
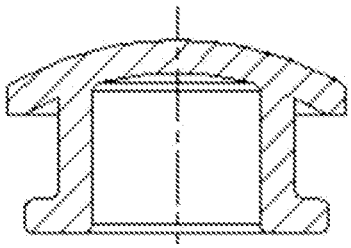

The second one-way valve 116 and/or the third one-way valve 1218*c* may include a sheet-shaped elastic material piece with a cross-shaped cutout, as shown in FIGS. 31A-31B. The sheet-shaped elastic material piece protrudes to a conducting side (upper side in FIG. 31A) to form an arch, and is provided with a cross-shaped cutout at an end located on the conducting side. Liquid (for example, detergent) and gas (for example, water vapor) may pass through the one-way valve in a direction toward the conduction side but cannot pass through the one-way valve in a direction away from the conduction side. The sheet-like elastic material piece is made of rubber, for example.

Referring back to FIGS. 26A and 26B, the first half shell 110 has two filling openings 1611, 1621 that form a first filling channel 161 and a second filling channel 162. The first filling channel 161 and the second filling channel 162 are respectively communicated with the first storage cavity and the second storage cavity, and are respectively covered by two filling caps 150. Each filling cap 150 is provided with a first one-way valve that is unidirectionally communicated from outside of the storage cavity to inside of the storage cavity. Therefore, the first one-way valve allows gas to enter the inside of the storage cavity from the outside of the storage cavity, while preventing the detergent from flowing out of the storage cavity.

When there is a negative pressure inside the storage cavity (for example, a negative pressure caused by the suction of the detergent in the storage cavity), the first one-way air valve and the third one-way valve 1218*c* can fill in air to reduce negative pressure. This is beneficial to realize the stable operation of the discharge pumps 131, 132, and prevents wall surfaces of the first half shell 110 and the second half shell 120 of the storage box from being deformed due to negative pressure.

Figure 23A:
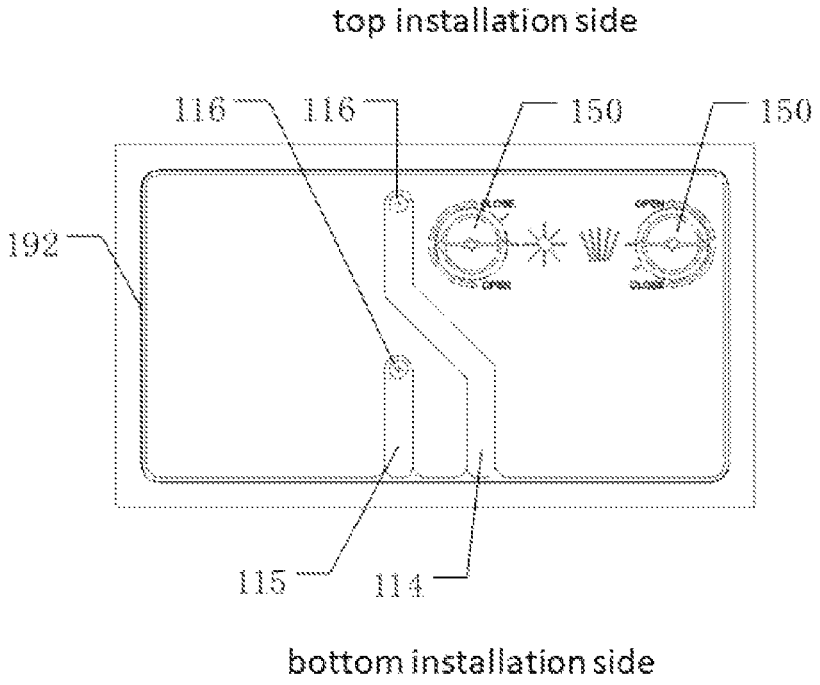
FIGS. 23A-23F show respectively a front view, a rear view, a right side view, a left side view, a top view and a bottom view of the detergent dispensing device shown in FIG. 22.
Figure 23B:
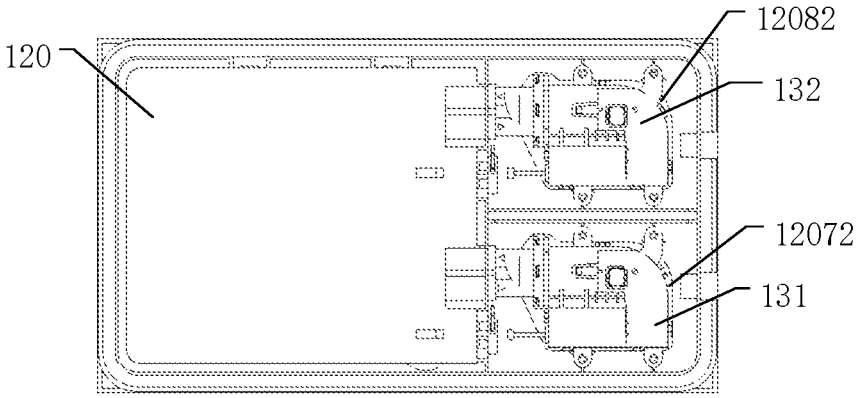
Figure 23C:
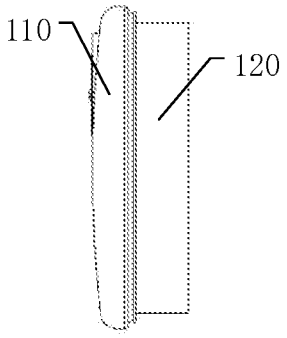
Figure 23D:
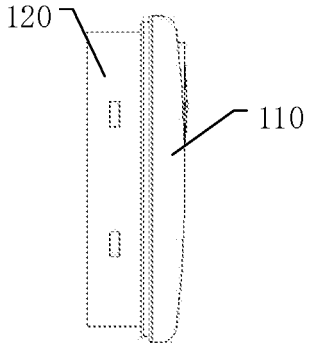
Figure 23E:
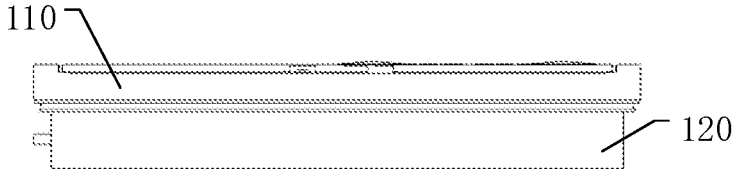
Figure 23F:
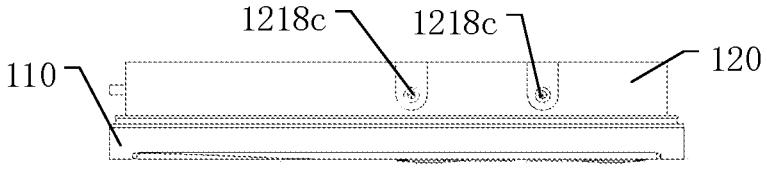

The first filling channel and the second filling channel are closer to a top installation side opposite to the bottom installation side (see FIG. 23A) than to the bottom installation side where the pivot axis is located (see FIG. 23A). Therefore, the time for the detergent to pass through the filling opening is reduced, thereby reducing the requirements for sealing reliability of the filling opening and reducing cost.

As shown in FIG. 28A and FIG. 29A, in this embodiment, the storage cavity has a first storage cavity and a second storage cavity. For example, the storage cavity is composed of a first storage cavity and a second storage cavity, and is in a rectangular form, and the first storage cavity is in a rectangular form and located at a corner of the storage cavity. The first storage cavity and the second storage cavity are separated by an L-shaped partition to be fluidly isolated from each other. The first storage cavity has a first side wall 1210 close to the bottom installation side and a second side wall 1211 opposite to the first side wall 1210 and close to the top installation side. The second storage cavity has a third side wall 1212 close to the bottom installation side and a fourth side wall 1213 opposite to the third side wall 1212 and close to the top installation side. The center of the first filling channel is closer to the second side wall 1211 than to the first side wall 1210. The center of the second filling channel is closer to the fourth side wall 1213 than to the third side wall 1212.

The second half shell 120 is provided with a first sump 1216 at the first side wall 1210 in the first chamber 1201 and a second sump 1217 at the third side wall 1212 in the third chamber 1203, respectively. Each of the first sump 1216 and the second sump 1217 protrudes outward to form a groove shape, the opening at the other end of the first inlet channel being arranged at the first sump 1216, and the opening at the other end of the second inlet channel being arranged at the second sump 1217. The first sump 1216 and the second sump 1217 help keep the opening at the other end of the first inlet channel and the opening at the other end of the second inlet channel immersed in the detergent, thereby preventing the gas from being drawn into the discharge pumps 131, 132. In this way, the suction amount of detergent can be controlled more accurately.

In addition, the first air inlet 1218*a* may be provided in the second side wall 1211, and the second air inlet 1218*b* may be provided in the fourth side wall 1213.

As shown in FIGS. 28A-29B clearly, the first storage cavity includes a first chamber 1201 and a second chamber 1202 separated by a first partition 1214 protruding from the bottom wall 1219 of the second half shell 120. The second storage cavity includes a third chamber 1203 and a fourth chamber 1204 separated by a second partition 1215 protruding from the bottom wall 1219 of the second half shell 120. The third chamber 343 and the fourth chamber 1204 are in communication through a gap between the second partition 1215 and the first half shell 110. The first chamber 1201 and the second chamber 1202 are in communication with each other through a gap between the first partition 1214 and the first half shell 110.

The second chamber 1202 is closer to the bottom installation side of the detergent dispensing device 100 than the first chamber 1201, and the fourth chamber 1204 is closer to the bottom installation side than the third chamber 1203.

It should be noted that the fact that the second chamber 1202 is closer to the bottom installation side than the first chamber 1201 does not mean that any part of the second chamber 1202 is closer to the bottom installation side than any part of the first chamber 1201, instead, as long as the second chamber 1202 is closer to the bottom installation side as whole than the first chamber 1201 as a whole, the detergent can be more easily retained in the second chamber 1202. Similarly, the fact the fourth chamber 1204 is closer to the bottom installation side than the third chamber 1203 does not mean that any part of the fourth chamber 1204 is closer to the bottom installation side than any part of the third chamber 1203, instead, it is just required that the fourth chamber 1204 as a whole is closer to the bottom installation side than the third chamber 1203 as a whole.

The detergent dispensing device 100 further includes a first liquid level sensor 171 and a second liquid level sensor 172. The first liquid level sensor 171 is configured to sense a first liquid level in the first storage cavity (namely the amount of the first detergent), and the second liquid level sensor 172 is configured to sense a second liquid level in the second storage cavity (namely the amount of the second detergent).

The first liquid level sensor 171 and the sensing of the first liquid level in the first storage cavity by the first liquid level sensor 171 will be described in detail below.

The first liquid level sensor 171 includes a first conductive probe 1711 and a second conductive probe 1712 arranged to be spaced apart from each other. The first liquid level sensor 171 may be in the first sensing state or the second sensing state. In the first sensing state, the first conductive probe 1711 and the second conductive probe 1712 are electrically connected to each other. In the second sensing state, the first conductive probe 1711 and the second conductive probe 1712 are electrically disconnected from each other. Specifically, the detergent is conductive. Therefore, when both the first conductive probe 1711 and the second conductive probe 1712 contact the detergent, the first conductive probe 1711 and the second conductive probe 1712 are electrically connected to each other; when any one of the first conductive probe 1711 and the second conductive probe 1712 is not in contact with the detergent, the first conductive probe 1711 and the second conductive probe 1712 are electrically disconnected from each other.

When the first liquid level sensor 171 enters the second sensing state, an alarm signal may be issued to indicate that a user needs to replenish the first detergent in the first storage cavity. For example, the alarm signal can cause an indicator light to flash, a speaker to beep, and a display screen to display an image or text indicating that detergent needs to be added.

The first liquid level sensor 171 itself is fixed in the storage box and works reliably, and is not movable like a float liquid level sensor. In addition, the first liquid level sensor 171 has a small volume and a simple structure.

The first conductive probe 1711 and the second conductive probe 1712 of the first liquid level sensor 171 are both arranged in the second chamber 1202. For example, in order to facilitate the wiring of wires of the first liquid level sensor 171, the second chamber 1202 is provided on a side close to the pump accommodating spaces. As described above, the second chamber 1202 is closer to the bottom installation side of the detergent dispensing device 100 than the first chamber 1201, which helps when the door 2 is placed in a horizontal position, the first detergent in the first storage cavity is more likely to be retained in the second chamber 1202 instead of being evenly distributed into both the first chamber 1201 and the second chamber 1202.

In other words, the second chamber 1202 is located at a corner of the first storage cavity. The first storage cavity has a first side wall 1210 close to the bottom installation side and a part of the bottom wall 1219 of which the normal line is parallel to the first direction. The first chamber 1201 and the second chamber 1202 share the first side wall 1210 and the bottom wall 1219.

For example, the volume of the second chamber 1202 is less than one-fifth of the volume of the first chamber 1201.

As described above, the door 2 can be rotated by an angle to be switched between an open position and a closed position. When the door 2 is in the open position, the storage box is in a horizontal position, and when the door 2 is in the closed position, the storage box is in a vertical position. The first conductive probe 1711 and the second conductive probe 1712 are arranged in the second chamber 1202, and are arranged such that when the storage box is in the vertical position or the horizontal position, the first liquid level sensor 171 is in the same state. That is, when the first liquid level sensor 171 is switched between the vertical position and the horizontal position, the first liquid level sensor 171 remains unchanged in one of the first sensing state and the second sensing state.

In the horizontal position, the first direction is parallel to the gravity direction, and the bottom wall 1219 is located at downstream side of the first storage cavity in the gravity direction. In the vertical position, the first direction is perpendicular to the gravity direction, and the first side wall 1210 is located at downstream side of the first storage cavity in the gravity direction.

It should be noted that, in other embodiments, when the detergent dispensing device is installed on the door 2, the storage box is not limited to being switched between the vertical position and the horizontal position. For example, the door 2 can be rotated by an angle of less than 90 degrees about the pivot axis.

The first partition 1214 includes a first sub partition 12141 parallel to the first side wall 1210 and a second sub partition 12142 perpendicular to the first side wall 1210 and the bottom wall 1219.

In order to realize that the first liquid level sensor 171 is in the same state regardless of whether the storage box is in a vertical position or a horizontal position, the positions of the first conductive probe 1711 and the second conductive probe 1712 may be appropriately arranged.

The second conductive probe 1712 is closer to the first side wall 1210 and the bottom wall 1219 than the first conductive probe 1711. Therefore, the second conductive probe 1712 is always easier to contact the detergent than the first conductive probe 1711.

Figure 32A:
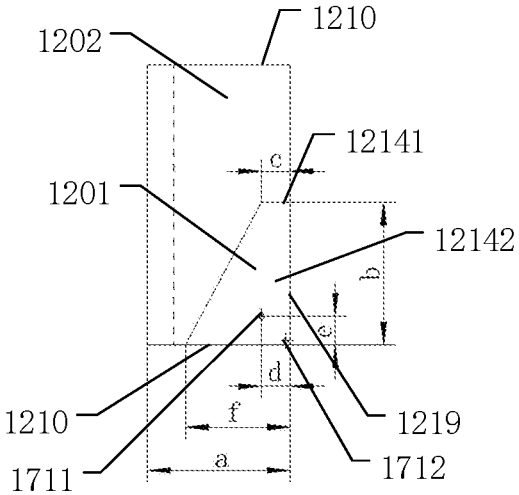
FIGS. 32A-32G show a schematic side view of a first storage cavity according to an embodiment of the present disclosure.

FIG. 32A shows a schematic side view of a first storage cavity according to an embodiment of the present disclosure.

As shown in FIG. 32A, the length of a first side of the second sub partition 12142 bordering the first sub partition 12141 is the first length c, the length of a second side of the second sub partition 12142 bordering the first side wall 1210 is the second length f, the height of the second sub partition 12142 between the first sub partition 12141 and the first side wall 1210 is the first height b, and the distance between the first conductive probe 1711 and the bottom wall 1219 is the first distance d, the distance between the first conductive probe 1711 and the first side wall 1210 is the second distance e, and the length of the first side wall 1210 of the first chamber 1201 is the third length a. For example, f>c.

The gap between the first partition 1214 and the first half shell 110 ensures that when the detergent dispensing device 100 is in a vertical state, the liquid levels in the first chamber 1201 and the second chamber 1202 will drop at the same time.

The thickness of the storage cavity in the first direction is smaller than the length of the storage cavity in the direction perpendicular to the first side wall 1210. When the storage box is in the vertical position, the first conductive probe 1711 contacts the first detergent. In order to ensure that when the storage box is switched to the horizontal position, the first conductive probe 1711 also contacts the first detergent, in the embodiment shown in FIG. 32A, the above parameters are set such that, the first length c, the second length f, and the first distance d meet:

c>d and f>d.

Figure 32B:
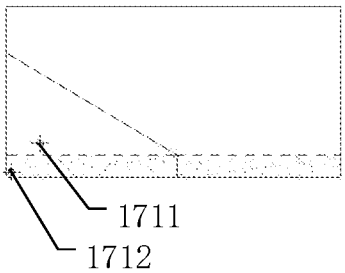

FIG. 32B shows a schematic side view of the first storage cavity according to another embodiment of the present disclosure, wherein c<d and f>d. It can be seen that in this embodiment, since c<d, when the storage box is switched to the horizontal position, the first conductive probe 1711 no longer contacts the first detergent.

In addition, the third length a, the first height b, the second distance e and the first distance d meet:

a*e=b*d.

Figure 32C:
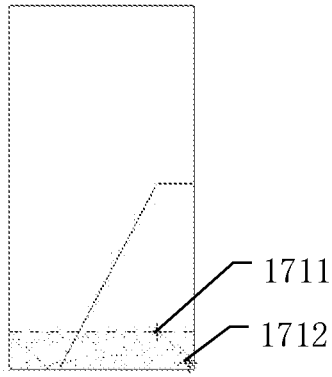
Figure 32D:
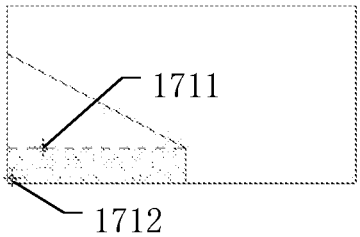

FIGS. 32C and 32D show additional schematic side views of the first storage cavity shown in FIG. 32A. In FIG. 32C, the storage box is in the vertical position, and the first conductive probe 1711 is at the liquid level of the first detergent. In FIG. 32D, the storage box is in the horizontal position, and the first conductive probe 1711 is at the liquid level of the first detergent.

Since a*e=b*d, the amount of detergent in the storage box shown in FIG. 32C is the same as the amount of detergent in the storage box shown in FIG. 32D. That is to say, whether the storage box is in the vertical position or the horizontal position, the contact state between the first conductive probe 1711 and the detergent is the same.

In addition, the third length a, the first height b, the second distance e, and the second length f meet:

f*b/2≥a*e.

Figure 32E:
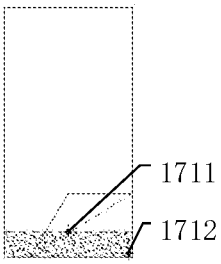
Figure 32F:
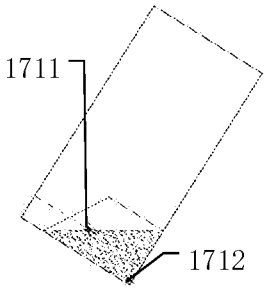
Figure 32G:
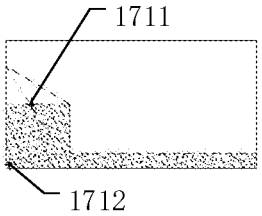

FIGS. 32E, 32F, and 32G show another schematic side view of the first storage cavity shown in FIG. 32A, which show that when the storage box is switched from the vertical position to the horizontal position, the liquid level of the first detergent in the storage box changes. In FIG. 32E, the storage box is in the vertical position, and the first conductive probe 1711 is at the liquid level of the first detergent. In FIG. 32F, the detergent starts to contact the first sub partition 12141, and the liquid level starts to completely overlap the second chamber 1202, and the first conductive probe 1711 is at the liquid level of the first detergent. In FIG. 32G, the storage box is in the horizontal position, and the first conductive probe 1711 is at the liquid level of the first detergent.

Since a*e=b*d and f*b/2≥a*e, the amount of detergent in the storage box shown in FIGS. 32E, 32F and 32G is the same. That is, regardless of whether the storage box is in the vertical position, the horizontal position, or a position between the vertical position and the horizontal position, the contact state between the first conductive probe 1711 and the detergent is the same.

In FIG. 32A, the dashed line indicates the joining surface between the first half shell 110 and the second half shell 120. As shown in FIG. 32A, the second sub partition 12142 may be provided only in the second half shell 120.

Figure 33:
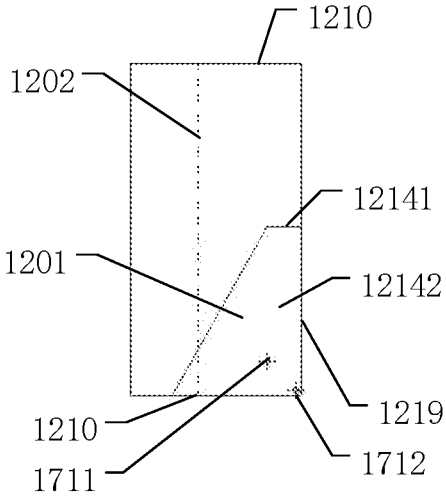
FIG. 33 shows a schematic side view of the first storage cavity according to another embodiment of the present disclosure.

FIG. 33 shows a schematic side view of the first storage cavity according to another embodiment of the present disclosure, wherein the dashed line indicates the joining surface between the first half shell 110 and the second half shell 120. As shown in FIG. 33, the second sub partition 12142 may also be composed of the first half shell 110 and the second half shell 120 together. Furthermore, in another embodiment, the first half shell 110 may be plate-shaped. In other words, the joining surface of the first half shell 110 and the second half shell 120 is substantially located at one side of the first storage cavity.

A third conductive probe 1721 and a fourth conductive probe 1722 of the second liquid level sensor 172, the third chamber 1203 and the fourth chamber 1204 can be arranged with reference to the first conductive probe 1711 and the second conductive probe 1712 of the first liquid level sensor 171, the first chamber 1201 and the second chamber 1202.

For example, the second liquid level sensor 172 includes a third conductive probe 1721 and a fourth conductive probe 1722. The second liquid level sensor 172 may be in a third sensing state or a fourth sensing state. In the third sensing state, the third conductive probe 1721 and the fourth conductive probe 1722 are electrically connected to each other. In the fourth sensing state, the third conductive probe 1721 and the fourth conductive probe 1722 are electrically disconnected from each other.

When the second liquid level sensor 172 enters the fourth sensing state, an alarm signal may be issued to indicate that a user needs to replenish the second detergent in the second storage cavity. For example, the alarm signal can cause an indicator light to flash, a speaker to beep, and a display screen to display an image or text indicating that detergent needs to be added.

The fourth chamber 1204 is located at a corner of the second storage cavity. The second storage cavity has a third side wall 1212 close to the bottom installation side and another part of the bottom wall 1219. The third chamber 1203 and the fourth chamber 1204 share the third side wall 1210 and the bottom wall 1219. For example, the volume of the fourth chamber 1204 is less than one-fifth of the volume of the third chamber 1203.

When the storage box is in the horizontal position, the bottom wall 1219 is located at downstream side of the second storage cavity in the direction of gravity. When the storage box is in the vertical position, the third side wall 1212 is located on downstream side of the second storage cavity in the direction of gravity.

The second partition 1215 includes a third sub partition parallel to the third side wall 1212 and a fourth sub partition perpendicular to the third side wall 1212 and the bottom wall 1219.

The third conductive probe 1721 and the fourth conductive probe 1722 of the second liquid level sensor 172 are both arranged in the fourth chamber 1204. The third conductive probe 1721 and the fourth conductive probe 1712 are arranged such that when the storage box is in the vertical position or the horizontal position, the second liquid level sensor 172 is in the same state. The fourth conductive probe 1722 is closer to the third side wall 1212 and the bottom wall 1219 than the third conductive probe 1721.

A fourth length g of a third side of the fourth sub partition bordering the third sub partition, and a fifth length h of a fourth side of the fourth sub partition bordering the third side wall 1212 (not shown in the figure), a second height i of the second sub partition between the first sub partition and the third side wall 1212 (not shown in the figure), a third distance j between the third conductive probe 1721 and the third side wall 1212 (not shown in the figure), a sixth length k of the third side wall 1212 in the first direction (not shown in the figure), and a fourth distance 1 between the third conductive probe 1721 and the bottom wall 1219 (not shown in the figure), meet:

$g>l$ and $h>l$;

$k*j=i*l$; and $h*i/2\geq k*j$.

Figure 34A:
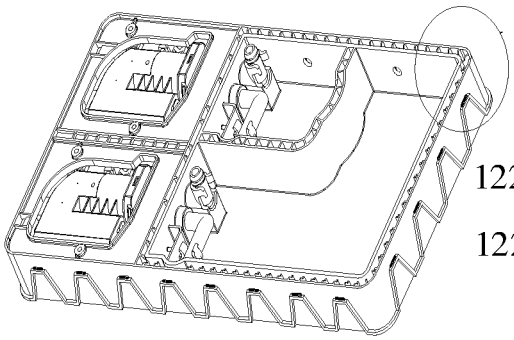
FIG. 34A shows a perspective view of a detergent dispensing device according to an embodiment of the present disclosure.
Figure 34B:
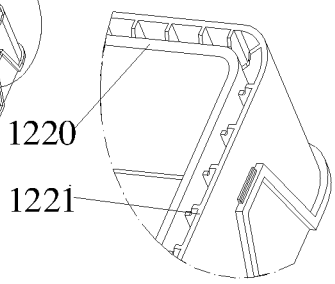
FIG. 34B shows an enlarged view of the circled part in FIG. 34A.

FIG. 34A shows a perspective view of the detergent dispensing device 100 according to an embodiment of the present disclosure, in which the first half shell 110 is not shown. FIG. 34B shows an enlarged view of the circled part in FIG. 34A.

As shown in FIGS. 34A and 34B, the second half shell 120 of the detergent dispensing device 100 is provided with a second inner side panel 1220 extending around the outer peripheral of the storage cavity. An end face of the second inner side panel 1220 is a welding face, and the edges of the openings of the pump accommodation spaces 1207, 1208 are also provided with welding faces.

Accordingly, as shown in FIGS. 25 and 26B, the first half shell 110 is provided with a first inner side panel 117 extending around the outer peripheral of the storage cavity, and an end face of the first inner side panel 117 is a welding face which corresponds to the welding face of the second inner side panel 1220. Accordingly, the first half shell 110 is also provided with two third inner side panels 118 corresponding to the edges of the two openings of the pump accommodating spaces 1207 and 1208, and an end face of the third inner side panel is a welding face.

The first half shell 110 and the second half shell 120 are aligned, and then corresponding welding faces are welded together by hot plate welding or ultrasonic welding to fixedly connect the first half shell 110 and the second half shell 120.

As shown in FIGS. 34A and 34B, the second half shell 120 is further provided with a second outer side panel 1221 extending around the outer periphery of the second half shell 120. Accordingly, as shown in FIGS. 25 and 26B, the first half shell 110 is further provided with a first outer side panel 119 extending around the outer periphery of the first half shell 110. The first outer side panel 119 constitutes a part of the annular groove 113. The end faces of the first outer side panel 119 and of the second outer side panel 1221 are opposite to each other. For example, the end faces of the first outer side panel 119 and of the second outer side panel 1221 abut against (or are overlapped) with each other.

FIGS. 35A and 35B schematically show the first inner side panel 117 and the second inner side panel 1220 as well as the first outer side panel 119 and the second outer side panel 1221 respectively before and after the first half shell 110 and the second half shell 120 are welded to each other.

It can be seen from FIGS. 35A and 35B that the first outer side panel 119 and the second outer side panel 1221 block weld scars, thereby improving the aesthetics of the detergent dispensing device 100.

In addition, a first art structure 191 may also be provided at an outer side at the ends of the first outer side panel 119 and of the second outer side panel 1221. The first art structure 191 reduces adverse effect to the aesthetics of the dispensing device caused by the alignment error of the first half shell 110 and the second half shell 120. For example, the first art structure 191 is a groove. Alternatively, the first art structure 191 may also be a protrusion.

For example, as shown in FIGS. 34A and 34B, reinforcing ribs may be provided between the second inner side panel 1220 and the second outer side panel 1221 to improve dimensional stability of the second half shell 120, since welding may cause deformation of the second half shell 120.

For example, the first half shell 110 and the second half shell 120 are both plastic molded parts.

Referring back to FIGS. 22 and 23A, a second art structure 192 is also provided in an outer side of the first half shell 110. For example, the second art structure 192 may be provided at locations where the material accumulates (i.e., at the intersection of two lines of the T shape) at the portion having T-shaped cross section of the first half shell 110. For example, the second art structure 192 is arranged around and close to the edge of the first half shell 110, and the projection of the second art structure 192 in the first direction and the projection of the first outer side panel 119 of the first half shell 110 overlap. For example, the second art structure 192 is a groove. Alternatively, the second art structure 192 may also be a protrusion.

Since the amount of material at each portion of a part made of the same material is different, so the amount of material deformation is different when there is a change in temperature. For example, during cooling, the amount of material shrinkage at locations where the material accumulates is greater, and therefore, sink marks may result. The second art structure 192 helps prevent the generation of sink marks. In addition, the arrangement of the second art structure 192 also helps to improve the aesthetics of the first half shell 110.

According to an embodiment of the present disclosure, there is also provided a dishwasher, which includes the detergent dispensing device as described above, such as the detergent dispensing device 3 or the detergent dispensing device 100.

The following describes in detail a discharge pump according to at least one embodiment of the present disclosure, which can be used in the detergent dispensing device described above, such as the detergent dispensing device 3 or the detergent dispensing device 100.

FIGS. 36-39 are perspective views of a discharge pump according to a first embodiment of the present disclosure. As shown in FIGS. 36-39, the discharge pump includes a pump housing 410, a motor 420, a transmission system 430, a chamber body 440, and an inlet-outlet portion 450.

The pump housing 410 includes a first half shell 411, a second half shell 412, and an end cover 413 that cooperate with each other to fix each other and define an accommodating space for the motor 420, the transmission system 430, and the chamber body 440. The first half shell 411, the second half shell 412, and the end cover 413 are fixed together, for example, by bonding, screw connection, snapping, or welding.

The transmission system 430 is coupled between an output shaft of the motor 420 and a pull rod 441 of the chamber body 440, and converts the rotational movement of the motor 420 into the reciprocating motion of the pull rod 441 of the chamber body 440. The chamber body 440 may further include a bellows 442, one end of which is fixed to the pull rod 441 and reciprocates with the pull rod 441, wherein since one end of pull tie rod 441 carries out a circular motion, the bellows 442 deforms during the reciprocating motion. Furthermore, the reciprocating movement of the pull rod 441 causes the volume of the chamber body 440 to change, so as to realize the suction and output of liquid from the inlet-outlet portion 450. The inlet-outlet portion 450 is provided at the end cover 413 and is in fluid communication with the chamber body 440. The inlet-outlet portion 450 can be used as the intake port and the outlet of the discharge pump of the detergent dispensing device described above.

Herein, the axis of the motor 420 is defined as the axis passing through its output shaft, and the axis of the chamber body 440 is defined as the axis parallel to the direction in which the volume changes (or the direction in which the pull rod 441 reciprocates). FIGS. 40 and 41 show respectively a perspective view and a top view of the discharge pump according to the present disclosure, in which the pump housing 410 is removed. As shown in FIGS. 40 and 41, the axis of the motor 420 is parallel to the axis of the chamber body 440, and the motor 420, the transmission system 430 and the chamber body 440 are arranged in a U shape. An end face of the chamber body 440 opposite to the pull rod 441 and an end face of the motor 420 opposite to its output end respectively form two ends of a U shape which may be flush with each other or offset from each other by a distance.

Since the motor 420, the transmission system 430 and the chamber body 440 are arranged in a U shape, the discharge pump can make effective use of space, realizing miniaturization of the overall structure, which is more conducive to installation on electrical appliances and other equipment.

The transmission system 430 includes a first-stage worm gear transmission 431, a second-stage gear transmission 432, and a third-stage gear transmission 433. In the first-stage worm gear transmission 431, a worm 434 is fixed or integrally formed to the output shaft of the motor 420, and coaxially coupled with a driving gear, namely a worm gear 435 in the second-stage gear transmission 432, and a driven gear in the second-stage gear transmission 432 is coaxially coupled with a driving gear in the third-stage gear transmission 433, and a driven gear in the third-stage gear transmission 433 is coupled to the pull rod 441.

The axis of the motor 420 and the axis of the chamber body 440 are arranged to form a plane. FIG. 42 is a view of the discharge pump viewed along the axis of the motor 420 according to the first embodiment of the present disclosure. As shown in FIG. 42, in the normal direction of the plane formed by the axis of the motor 420 and the axis of the chamber body 440 (in this example, the axis of the motor 420 and the axis of the chamber body 440 are parallel, therefore, in other words, in a section perpendicular to the axis of the motor 420 and the axis of the chamber body 440), the height of the overall gear train of the transmission system 430, that is, the overall height of the transmission components (including gears, worm gears, and worms) at all stages constituting the transmission system is designed to be less than or equal to the diameter of the motor. Therefore, the discharge pump is further downsized in the height direction. In addition, the diameter of the motor is smaller than the overall height of the discharge pump. Therefore, the height of the discharge pump in a specific direction is particularly small, which is particularly advantageous in the case where the discharge pump is installed in an interlayer of a dishwasher or a washing machine.

In order to sense the amount of liquid added by the discharge pump, the discharge pump according to the present disclosure further includes a sensing device. As shown in FIGS. 43A and 43B, the sensing device according to the first embodiment of the present disclosure includes a first sensing element 461 which may be a Hall element fixed to the pump housing 410 and a second sensing element 462 which may be a magnetic steel cooperated with the Hall element and fixed to the pull rod 441.

FIG. 43A shows a top view of the discharge pump including the sensing device according to the first embodiment of the present disclosure, in which the second sensing element 462 moves with the pull rod 441 to a first position. FIG. 43B shows a top view of the discharge pump including the sensing device according to the first embodiment of the present disclosure, in which the second sensing element 462 moves with the pull rod 441 to a second position. As shown in FIG. 43A, when in the first position, the pull rod 441 is in a maximumly stretched state, in which the second sensor element 462 fixed to the pull rod 441 is closest to the first sensor element 461, and the magnetic field sensed by the first sensor element 461 is the largest. As shown in FIG. 43B, when in the second position, the pull rod 441 is in the maximumly compressed state, in which the second sensor element 462 fixed to the pull rod 441 is the farthest from the first sensor element 461, and the magnetic field sensed by the first sensor element 461 is the smallest. Therefore, the sensing device can accurately sense the reciprocating movement period and/or speed of the pull rod 441, and feedback relevant information to a control device to control the output of the motor 420, thereby accurately controlling the dispensing amount of the discharge pump. In addition, since the second sensing element 462 is provided on the pull rod 441, the sensing device can more accurately sense the reciprocating movement of the pull rod 441 and thereby sense the current filling amount, so as to more accurately control the dispensing amount of the discharge pump than in the case where the second sensing element is provided at a transmission position of the output shaft or the drive train.

Preferably, the motor 420 used in the discharge pump according to the present disclosure is a DC motor. Therefore, compared with a synchronous motor, it can provide a larger torque and output a larger flow rate while occupying the same volume. At the same time, the sensing device allows the discharge pump employing the DC motor 420 to achieve accurate liquid output.

FIGS. 44A and 44B show a sensing device of the discharge pump according to a second embodiment of the present disclosure. The difference from the first embodiment is that the second sensor element 562 of the sensor device of the discharge pump according to the second embodiment is arranged on the output shaft of the motor 520, and the first sensor element 561 is arranged on the pump housing 410 near the second sensing element 562. Since the transmission ratio of the transmission system 530 is constant, the output shaft of the motor 520 can also be sensed to control the output of the motor. In order to make more effective use of space, the second sensing element 562 may be disposed on a side opposite to the output end of the motor 520. The first sensing element 561 may be a Hall element, and the second sensing element 562 may be a magnetic ring, which may have an N pole and an S pole. As the second sensing element 562 rotates, when its N pole is close to the first sensing element 561, a high or low electrical signal is generated, and when its S pole is close to the first sensing element 561, an opposite signal is generated.

The sensing device is not limited to a Hall element and a magnetic steel or a Hall element and a magnetic ring, and may also include other components for sensing the relative position or rotation speed, such as a reed switch assembly.

In the second embodiment, the number of revolutions of the motor 520 corresponding to the pumping volume that meets the needs of an end customer can be expressed by the following formula: N=(ni/q)*Q. Wherein, q represents a pumping volume of the cavity 540 compressed once, i represents the transmission ratio of the transmission system, n represents the number of revolutions of the motor 520 corresponding to the pumping volume q, and Q represents the pumping volume required by the end customer, ni/q is a constant value for the discharge pump, and when the value of Q is input, the value of N can be obtained. When the number of revolutions of the motor is sensed to become N, the control device can control the motor to stop working.

The various components in the discharge pump according to the present disclosure may have various different arrangements. The following introduces other arrangements of the discharge pump, but the present disclosure is not limited to this, and the arrangement of various components in the discharge pump can be adjusted according to customer needs and the requirements of an electrical equipment to which the discharge pump is to be installed.

FIG. 45 shows a top view of a discharge pump according to a third embodiment of the present disclosure. As shown in FIG. 45, different from the first embodiment, in the discharge pump according to the third embodiment, the motor 620, the transmission system 630 and the chamber body 640 are arranged in an L shape. An end face of the chamber body 640 opposite to the pull rod and an end face of the motor 520 opposite to its output end respectively form two ends of the L shape.

FIG. 46 shows a top view of a discharge pump according to a fourth embodiment of the present disclosure. As shown in FIG. 45, different from the first embodiment, in the discharge pump according to the fourth embodiment, the motor 720, the transmission system 730, and the chamber body 740 are arranged in a Z shape. The end face of the chamber body 740 opposite to the pull rod and the end face of the motor 720 opposite to its output end respectively form two ends of the Z shape.

In addition, in other embodiments, the motor 720, the transmission system 730, and the chamber body 740 may be arranged in a straight line.

The scope of the present disclosure is not limited by the above-described embodiments, but by the appended claims and their equivalents.

The disclosure within the specification is exemplified by the following numbered paragraphs:

Numbered Paragraph 1. A detergent dispensing device for a dishwasher, including:

a storage box including a first half shell and a second half shell fixedly connected to each other in a first direction to define a storage cavity for storing detergent;

a discharge pump configured to suck the detergent from the storage cavity and to dispense the detergent to the outside of the detergent dispensing device; and a pipeline module including a filling channel for filling detergent to the storage cavity, an inlet channel for extracting the detergent from the storage cavity by the discharge pump, and an output channel for dispensing the detergent by the discharge pump, wherein the second half shell defines a pump accommodating space for accommodating at least a part of the discharge pump.

Numbered Paragraph 2. The detergent dispensing device as described in Numbered Paragraph 1, wherein the storage cavity includes a first storage cavity for storing a first detergent and a second storage cavity for storing a second detergent;

the discharge pump is configured to suck the first detergent from the first storage cavity and to dispense the first detergent to the outside of the detergent dispensing device, and to suck the second detergent from the second storage cavity and to dispense the second detergent to the outside of the detergent dispensing device;

the pipeline module includes a first filling channel for filling the first detergent to the first storage cavity, a second filling channel for filling the second detergent to the second storage cavity, a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump.

Numbered Paragraph 3. The detergent dispensing device as described in Numbered Paragraph 2, wherein one ends of the first inlet channel and of the second inlet channel are respectively connected to a first intake port and a second intake port of the discharge pump, while the other ends of the first inlet channel and of the second inlet channel are respectively in communication with the first storage cavity and the second storage cavity;

one ends of the first outlet channel and of the second outlet channel are respectively connected to a first outlet and a second outlet of the discharge pump, and the other ends of the first outlet channel and of the second outlet channel are respectively communicated with the outside of the detergent dispensing device.

Numbered Paragraph 4. The detergent dispensing device as described in Numbered Paragraph 2, further including:

at least two filling caps, the first filling channel and the second filling channel are respectively communicated with the first storage cavity and the second storage cavity, and are respectively covered by the two filling caps, each filling cap is provided with a first one-way valve that is unidirectionally communicated from the outside of the storage cavity to the inside of the storage cavity.

Numbered Paragraph 5. The detergent dispensing device as described in Numbered Paragraph 4, wherein the filling cap is screwed into a corresponding one of the first filling channel and the second filling channel along a screw-in circumferential direction, the filling caps each has a filling cap connecting portion which is in the shape of a hook that opens in the screw-in circumferential direction, a wall defining the corresponding one of the first filing channel and the second filling channel is provided with a pipeline module connection portion which is in the shape of a hook that opens in opposite direction of the screw-in circumferential direction, the filling cap connecting portion has a protrusion, and the pipeline module connecting portion has a recess, the filling cap connection portion and the pipeline module connection portion are hooked to each other with the protrusion inserted into the recess.

Numbered Paragraph 6. The detergent dispensing device as described in Numbered Paragraph 3, wherein the second half shell includes a bottom wall, a normal direction of which is parallel to a first direction;

the first storage cavity includes a first chamber and a second chamber separated by a first partition protruding from the bottom wall of the second half shell, the second storage cavity includes a third chamber and a fourth chamber separated by a second partition protruding from the bottom wall of the second half shell, the third chamber and the fourth chamber are communicated with each other through a gap between the second partition and the first half shell, the first chamber and the second chamber are communicated with each other through a gap between the first partition and the first half shell, the second chamber is closer to a bottom installation side of the detergent dispensing device than the first chamber, and the fourth chamber is closer to the bottom installation side than the third chamber.

Numbered Paragraph 7. The detergent dispensing device as described in Numbered Paragraph 6, further including:

at least two filling caps, the first filling channel and the second filling channel are arranged in the first half shell, and the first filling channel and the second filling channel are respectively communicated with the first storage cavity and the second storage cavity and are respectively covered by the two filling caps, the first filling channel and the second filling channel are closer to a top installation side opposite to the bottom installation side than to the bottom installation side.

Numbered Paragraph 8. The detergent dispensing device as described in Numbered Paragraph 2, further including:

a first liquid level sensor configured to sense a first liquid level in the first storage cavity, and a second liquid level sensor configured to sense a second liquid level in the second storage cavity.

Numbered Paragraph 9. The detergent dispensing device as described in Numbered Paragraph 2, wherein the discharge pump includes a separate first discharge pump configured to suck the first detergent from the first storage cavity and to dispense the first detergent to the outside of the detergent dispensing device and a separate second discharge pump configured to suck the second detergent from the second storage cavity and to dispense the second detergent to the outside of the detergent dispensing device.

Numbered Paragraph 10. The detergent dispensing device as described in Numbered Paragraph 9, wherein each of the first discharge pump and the second discharge pump includes:

a motor;

a chamber body having a pull rod, and reciprocating movement of the pull rod causes the volume of the chamber body to change;

a transmission system coupled between an output shaft of the motor and the pull rod of the chamber body, and converts the rotational movement of the motor into the reciprocating motion of the pull rod of the chamber body; and a pump housing accommodating the motor, the chamber body and the transmission system.

Numbered Paragraph 11. The detergent dispensing device as described in Numbered Paragraph 10, further including:

a sensing device used for sensing reciprocating movement of the pull rod including:

a first sensing element fixed relative to the pump housing; and a second sensing element cooperating with the first sensing element and fixed to any one of the output shaft of the motor, the transmission system or the pull rod of the chamber body.

Numbered Paragraph 12. The detergent dispensing device as described in Numbered Paragraph 11, wherein the second sensing element is fixed to the pull rod of the chamber body.

Numbered Paragraph 13. The detergent dispensing device as described in Numbered Paragraph 10, wherein the overall height of the transmission system in normal direction of a plane formed by an axis of the motor and an axis of the chamber body is less than or equal to a diameter of the motor, the axis of the motor passing through its output shaft, the axis of the chamber body being parallel to a direction in which the volume changes.

Numbered Paragraph 14. The detergent dispensing device as described in Numbered Paragraph 13, wherein the axis of the motor is parallel to the axis of the chamber body.

Numbered Paragraph 15. The detergent dispensing device as described in Numbered Paragraph 14, wherein the motor, the transmission system, and the chamber body are sequentially arranged in a U shape.

Numbered Paragraph 16. The detergent dispensing device as described in any one of Numbered Paragraphs 10-15, wherein the transmission system is composed of a first-stage worm gear transmission, a second-stage gear transmission, and a third-stage gear transmission, and a worm gear in the first-stage worm gear transmission is coaxially arranged with a driving gear in the second-stage gear transmission, and a driven gear in the second-stage gear transmission is coaxially arranged with a driving gear in the third-stage gear transmission.

Numbered Paragraph 17. The detergent dispensing device as described in any one of Numbered Paragraphs 10-15, wherein the motor is a DC motor.

Numbered Paragraph 18. The detergent dispensing device as described in Numbered Paragraph 3, wherein the first half shell includes an upper cover plate and a cover, the second half shell and the upper cover plate defining the storage cavity, and the cover being fixed to the upper cover plate to cover and isolate the discharge pump and the pipeline module.

Numbered Paragraph 19. The detergent dispensing device as described in Numbered Paragraph 18, further including:

at least two filling caps, the first filling channel and the second filling channel are respectively communicated with the first storage cavity and the second storage cavity, and are respectively covered by the two filling caps, the pipeline module includes a pipeline module body, the pipeline module body includes a first filling channel, a second filling channel, a first inlet channel, a second inlet channel, a first outlet channel, and a second outlet channel, and the pipeline module body is integrally formed.

Numbered Paragraph 20. The detergent dispensing device as described in Numbered Paragraph 19, wherein the pipeline module body is integrally formed with the upper cover plate.

Numbered Paragraph 21. The detergent dispensing device as described in Numbered Paragraph 19, wherein one ends of the first inlet channel and of the second inlet channel are respectively connected to a first intake port and a second intake port of the discharge pump, while the other ends of the first inlet channel and of the second inlet channel are respectively in communication with the first storage cavity and the second storage cavity;

one ends of the first outlet channel and of the second outlet channel are respectively connected to a first outlet and a second outlet of the discharge pump, and the other ends of the first outlet channel and of the second outlet channel are respectively communicated with the outside of the detergent dispensing device, one ends of the first filling channel and of the second filling channel are respectively communicated with the outside of the pipeline module and covered by the filling cap, and the other ends of the first filling channel and the second filling channel are respectively communicated with the first storage cavity and the second storage cavity.

Numbered Paragraph 22. The detergent dispensing device as described in Numbered Paragraph 6, wherein the second storage cavity further includes a second inlet cavity, the other end of the first filling channel is opened to the first chamber, and the other end of the first filling channel is opened to the second chamber;

the other end of the second filling channel is opened to the third chamber, and the other end of the second filling channel is opened to the second inlet cavity, the fourth chamber is in communication with the second inlet cavity through a second inlet guiding hole, the height of the second inlet guiding hole is smaller than the height of the second partition.

Numbered Paragraph 23. The detergent dispensing device as described in Numbered Paragraph 22, wherein the second storage cavity further includes a fifth chamber and a sixth chamber separated by a third partition protruding from the bottom wall of the second half shell, the fifth chamber and the sixth chamber are communicated with each other through a gap between the third partition and the first half shell, and the sixth chamber is closer to the bottom installation side than the fifth chamber, the third chamber and the fifth chamber are in communication with each other through a through hole, the sixth chamber is communicated with the second inlet cavity through the second inlet guiding hole, the height of the second inlet guiding hole is smaller than the height of the third partition, the height of the through hole is not lower than the height of the second partition and the height of the third partition.

Numbered Paragraph 24. The detergent dispensing device as described in Numbered Paragraph 23, wherein the second inlet guiding hole makes the fourth chamber and the sixth chamber communicated with the second inlet cavity respectively at locations of the fourth chamber and the sixth chamber close to the bottom installation side.

Numbered Paragraph 25. The detergent dispensing device as described in Numbered Paragraph 18, wherein the box body is provided with an inner side panel surrounding its outer periphery and an outer side panel located outside the inner side panel, the inner side panel and the upper cover plate being welded together to close the storage box, and the height of the inner side panel being higher than that of the outer side panel.

Numbered Paragraph 26. The detergent dispensing device as described in Numbered Paragraph 25, wherein the height of the inner side panel being higher than that of the outer side panel, and the first half shell has a boss protruding toward the outer side panel, and an end face of the outer side panel abuts against an end face of the boss.

Numbered Paragraph 27. The detergent dispensing device as described in Numbered Paragraph 1, wherein both ends of the pump accommodating space of the second half shell in the first direction have a first opening close to the first half shell and a second opening away from the first half shell to allows the discharge pump to protrude from the first opening and the second opening.

Numbered Paragraph 28. The detergent dispensing device as described in Numbered Paragraph 27, wherein the contour of the second opening is larger than that of the discharge pump, so that the discharge pump can be detachably fixed to the second half shell from the second opening.

Numbered Paragraph 29. The detergent dispensing device as described in Numbered Paragraph 27, wherein the storage cavity includes a first storage cavity for storing a first detergent and a second storage cavity for storing a second detergent;

the pipeline module includes a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump.

Numbered Paragraph 30. The detergent dispensing device as described in Numbered Paragraph 29, wherein the pipeline module includes a first inlet tube in which the first inlet channel extends, and a second inlet tube in which the second inlet channel extends, a first outlet tube in which the first outlet channel extends and a second outlet tube in which the second outlet channel extends, the first inlet tube, the second inlet tube, the first outlet tube and the second outlet tube are each a separate integrated piece.

Numbered Paragraph 31. The detergent dispensing device as described in Numbered Paragraph 30, wherein the first half shell and the second half shell are respectively an integral piece, and the first half shell and second half shell define an internal space in which the storage cavity and the pump are accommodated, the first inlet tube, the second inlet tube, the first outlet tube, and the second outlet tube are installed in the internal space.

Numbered Paragraph 32. The detergent dispensing device as described in Numbered Paragraph 6, further including:

a first liquid level sensor configured to sense a first liquid level in the first storage cavity.

the first liquid level sensor includes a first conductive probe and a second conductive probe, and is in a first sensing state in which the first conductive probe and the second conductive probe are electrically connected to each other or a second sensing state in which the first conductive probe and the second conductive probe are electrically disconnected from each other, the first storage cavity has a first side wall close to the bottom installation side and a part of the bottom wall, the first conductive probe and the second conductive probe are arranged in the second chamber, and are arranged such that when the storage box is in a vertical position or a horizontal position, the first liquid level sensor is in the same state, in the horizontal position, the first direction is parallel to the gravity direction, and the bottom wall is located at downstream side of the first storage cavity in the gravity direction, in the vertical position, the first direction is perpendicular to the gravity direction, and the first side wall is located at downstream side of the first storage cavity in the gravity direction.

Numbered Paragraph 33. The detergent dispensing device as described in Numbered Paragraph 32, wherein the second chamber is located at a corner of the first storage cavity, the first partition includes a first sub partition parallel to the first side wall and a second sub partition perpendicular to the first side wall and the bottom wall, the second conductive probe is closer to the first side wall and the bottom wall than the first conductive probe, A first length c of a first side of the second sub partition bordering the first sub partition, and a second length f of a second side of the second sub partition bordering the first side wall, and a first distance d between the first conductive probe and the bottom wall meet:

c>d and f>d.

Numbered Paragraph 34. The detergent dispensing device as described in Numbered Paragraph 33, wherein the first distance d, a first height b of the second sub partition between the first sub partition and the first side wall, a second distance e between the first conductive probe and the first side wall, and a third length a of the first side wall in the first direction meet:

a*e=b*d.

Numbered Paragraph 35. The detergent dispensing device as described in Numbered Paragraph 34, wherein the second length f, the height b, the third length a, and the second distance e meet:

f*b/2≥a*e.

Numbered Paragraph 36. The detergent dispensing device as described in Numbered Paragraph 35, wherein the first length c and the second length f meet:

f>c.

Numbered Paragraph 37. The detergent dispensing device as described in Numbered Paragraph 6, wherein the second half shell is provided with a first sump near the bottom installation side in the first chamber, and with a second sump near the bottom installation side in the third chamber, each of the first sump and the second sump protruding outward, An opening at the other end of the first inlet channel is arranged at the first sump, and an opening at the other end of the second inlet channel is arranged at the second sump.

Numbered Paragraph 38. The detergent dispensing device as described in Numbered Paragraph 29, wherein one ends of the first inlet channel and of the second inlet channel are respectively connected to a first intake port and a second intake port of the discharge pump, while the other ends of the first inlet channel and of the second inlet channel are respectively in communication with the first storage cavity and the second storage cavity;

one ends of the first outlet channel and of the second outlet channel are respectively connected to a first outlet and a second outlet of the discharge pump, and the other ends of the first outlet channel and of the second outlet channel are respectively communicated with the outside of the detergent dispensing device, an outer side of the first half shell opposite to the second half shell is provided with a first detergent guiding groove to which the other end of the first outlet channel is opened and a second detergent guiding groove to which the other end of the second outlet channel is opened.

Numbered Paragraph 39. The detergent dispensing device as described in Numbered Paragraph 29, wherein one ends of the first inlet channel and of the second inlet channel are respectively connected to a first intake port and a second intake port of the discharge pump, while the other ends of the first inlet channel and of the second inlet channel are respectively in communication with the first storage cavity and the second storage cavity;

one ends of the first outlet channel and of the second outlet channel are respectively connected to a first outlet and a second outlet of the discharge pump, and the other ends of the first outlet channel and of the second outlet channel are respectively communicated with the outside of the detergent dispensing device, the opening at the other end of the first outlet channel and the opening at the other end of the second outlet channel are arranged on the outer side of the first half shell opposite to the second half shell, and both the opening at the other end of the first outlet channel and the opening at the other end of the second outlet channel are provided with a second one-way valve.

Numbered Paragraph 40. A dishwasher including:

a main body with an opening;

a door closing the opening and having an inner plate and an outer plate; and the detergent dispensing device as described in any one of Numbered Paragarphs 1-39, the detergent dispensing device is mounted to the door such that at least a part of the second half shell is disposed between the inner plate and the outer plate.

Numbered Paragraph 41. The dishwasher as described in Numbered Paragraph 40, wherein the door is pivotally connected to a lower part of the main body, and is switched between an open position and a closed position by turning around a rotation axis. In the open position, the door is configured to be placed horizontally relative to the gravity direction, while in the closed position, the door is configured to be placed vertically relative to the gravity direction, the detergent dispensing device is mounted to the door such that the bottom installation side of the detergent dispensing device is close to the pivot axis of the door.

Numbered Paragraph 42. A dishwasher including:

a main body with an opening;

a door closing the opening and having an inner plate and an outer plate; and the detergent dispensing device as described in any one of Numbered Paragarphs 18-21, the second half shell is located on the side of the outer plate and the upper cover plate is located on the side of the inner plate, the pipeline module is fixed to the upper cover plate from one side of the inner plate, the inner plate is sandwiched between the cover and the upper cover plate.

What is claimed is:

1. A detergent dispensing device for a dishwasher, including:

a storage box including a first half shell and a second half shell fixedly connected to each other in a first direction to define a storage cavity for storing detergent, the storage box including a first storage cavity for storing a first detergent and a second storage cavity for storing a second detergent;

a discharge pump configured to suck the first detergent from the first storage cavity and to dispense the first detergent to the outside of the detergent dispensing device, and to suck the second detergent from the second storage cavity and to dispense the second detergent to the outside of the detergent dispensing device; and a pipeline module including a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump, wherein the second half shell defines a pump accommodating space for accommodating at least a part of the discharge pump, both ends of the pump accommodating space of the second half shell in the first direction have a first opening close to the first half shell and a second opening away from the first half shell to allows the discharge pump to protrude from the first opening and the second opening.

2. The detergent dispensing device as claimed in claim 1, wherein the contour of the second opening is larger than that of the discharge pump, so that the discharge pump can be detachably fixed to the second half shell from the second opening.

3. The detergent dispensing device as claimed in claim 1, wherein the discharge pump includes a separate first discharge pump configured to suck the first detergent from the first storage cavity and to dispense the first detergent to the outside of the detergent dispensing device and a separate second discharge pump configured to suck the second detergent from the second storage cavity and to dispense the second detergent to the outside of the detergent dispensing device, wherein each of the first discharge pump and the second discharge pump includes:

a motor;

a chamber body having a pull rod, and reciprocating movement of the pull rod causes the volume of the chamber body to change;

a transmission system coupled between an output shaft of the motor and the pull rod of the chamber body, and converts the rotational movement of the motor into the reciprocating motion of the pull rod of the chamber body; and a pump housing accommodating the motor, the chamber body and the transmission system, wherein the overall height of the transmission system in normal direction of a plane formed by an axis of the motor and an axis of the chamber body is less than or equal to a diameter of the motor, the axis of the motor passing through its output shaft, the axis of the chamber body being parallel to a direction in which the volume changes.

4. The detergent dispensing device as claimed in claim 3, further including:

a sensing device used for sensing reciprocating movement of the pull rod including:

a first sensing element fixed relative to the pump housing; and a second sensing element cooperating with the first sensing element and fixed to any one of the output shaft of the motor, the transmission system or the pull rod of the chamber body.

5. The detergent dispensing device as claimed in claim 3, wherein the axis of the motor is parallel to the axis of the chamber body, and the motor, the transmission system, and the chamber body are sequentially arranged in a U shape.

6. The detergent dispensing device as claimed in claim 3, wherein the transmission system is composed of a first-stage worm gear transmission, a second-stage gear transmission, and a third-stage gear transmission, and a worm gear in the first-stage worm gear transmission is coaxially arranged with a driving gear in the second-stage gear transmission, and a driven gear in the second-stage gear transmission is coaxially arranged with a driving gear in the third-stage gear transmission, and the motor is a DC motor.

7. The detergent dispensing device as claimed in claim 1, wherein the second half shell includes a bottom wall, a normal direction of which is parallel to a first direction;

the first storage cavity includes a first chamber and a second chamber separated by a first partition protruding from the bottom wall of the second half shell, the second storage cavity includes a third chamber and a fourth chamber separated by a second partition protruding from the bottom wall of the second half shell, the third chamber and the fourth chamber are communicated with each other through a gap between the second partition and the first half shell, the first chamber and the second chamber are communicated with each other through a gap between the first partition and the first half shell, the second chamber is closer to a bottom installation side of the detergent dispensing device than the first chamber, and the fourth chamber is closer to the bottom installation side than the third chamber.

8. The detergent dispensing device as claimed in claim 7, further including:

a first liquid level sensor configured to sense a first liquid level in the first storage cavity, the first liquid level sensor includes a first conductive probe and a second conductive probe, and is in a first sensing state in which the first conductive probe and the second conductive probe are electrically connected to each other or a second sensing state in which the first conductive probe and the second conductive probe are electrically disconnected from each other, the first storage cavity has a first side wall close to the bottom installation side and a part of the bottom wall, the first conductive probe and the second conductive probe are arranged in the second chamber, and are arranged such that when the storage box is in a vertical position or a horizontal position, the first liquid level sensor is in the same state, in the horizontal position, the first direction is parallel to the gravity direction, and the bottom wall is located at downstream side of the first storage cavity in the gravity direction, in the vertical position, the first direction is perpendicular to the gravity direction, and the first side wall is located at downstream side of the first storage cavity in the gravity direction.

9. The detergent dispensing device as claimed in claim 8 wherein the second chamber is located at a corner of the first storage cavity, the first partition includes a first sub partition parallel to the first side wall and a second sub partition perpendicular to the first side wall and the bottom wall, the second conductive probe is closer to the first side wall and the bottom wall than the first conductive probe, a first length c of a first side of the second sub partition bordering the first sub partition, and a second length f of a second side of the second sub partition bordering the first side wall, and a first distance d between the first conductive probe and the bottom wall satisfy:

c>d and f>d.

10. The detergent dispensing device as claimed in claim 9, wherein the first distance d, a first height b of the second sub partition between the first sub partition and the first side wall, a second distance e between the first conductive probe and the first side wall, and a third length a of the first side wall in the first direction satisfy:

a*e=b*d, the second length f, the height b, the third length a, and the second distance e satisfy:

f*b/2≥a*e.

11. The detergent dispensing device as claimed in claim 10, wherein the first length c and the second length f satisfy:

f>c.

12. The detergent dispensing device as claimed in claim 7, wherein the second half shell is provided with a first sump near the bottom installation side in the first chamber, and with a second sump near the bottom installation side in the third chamber, each of the first sump and the second sump protruding outward, an opening at the other end of the first inlet channel being arranged at the first sump, and an opening at the other end of the second inlet channel being arranged at the second sump.

13. The detergent dispensing device as claimed in claim 7, further including:

at least two filling caps, the pipeline module further includes a first filling channel for filling the first detergent to the first storage cavity and a second filling channel for filling liquid to the second storage cavity, the first filling channel and the second filling channel are arranged in the first half shell, and the first filling channel and the second filling channel are respectively communicated with the first storage cavity and the second storage cavity and are respectively covered by the two filling caps, the first filling channel and the second filling channel are closer to a top installation side opposite to the bottom installation side than to the bottom installation side.

14. The detergent dispensing device as claimed in claim 7, wherein the pipeline module further includes a first filling channel for filling the first detergent to the first storage cavity and a second filling channel for filling liquid to the second storage cavity, the second storage cavity further includes a second inlet cavity, the other end of the first filling channel is opened to the first chamber, and the other end of the first filling channel is opened to the second chamber;

the other end of the second filling channel is opened to the third chamber, and the other end of the second filling channel is opened to the second inlet cavity, the fourth chamber is in communication with the second inlet cavity through a second inlet guiding hole, the height of the second inlet guiding hole is smaller than the height of the second partition, the second storage cavity further includes a fifth chamber and a sixth chamber separated by a third partition protruding from the bottom wall of the second half shell, the fifth chamber and the sixth chamber are communicated with each other through a gap between the third partition and the first half shell, and the sixth chamber is closer to the bottom installation side than the fifth chamber, the third chamber and the fifth chamber are in communication with each other through a through hole, the sixth chamber is communicated with the second inlet cavity through the second inlet guiding hole, the height of the second inlet guiding hole is smaller than the height of the third partition, the height of the through hole is not lower than the height of the second partition and the height of the third partition, the second inlet guiding hole makes the fourth chamber and the sixth chamber communicated with the second inlet cavity respectively at locations of the fourth chamber and the sixth chamber close to the bottom installation side.

15. The detergent dispensing device as claimed in claim 1, wherein the pipeline module includes a first inlet tube in which the first inlet channel extends, and a second inlet tube in which the second inlet channel extends, a first outlet tube in which the first outlet channel extends and a second outlet tube in which the second outlet channel extends, the first inlet tube, the second inlet tube, the first outlet tube and the second outlet tube are each a separate integrated piece.

16. The detergent dispensing device as claimed in claim 15, wherein the first half shell and the second half shell are respectively an integral piece, and the first half shell and second half shell define an internal space in which the storage cavity and the pump are accommodated, the first inlet tube, the second inlet tube, the first outlet tube, and the second outlet tube are installed in the internal space.

17. The detergent dispensing device as claimed in claim 1, further including:

at least two filling caps, the pipeline module further includes a first filling channel for filling the first detergent to the first storage cavity and a second filling channel for filling liquid to the second storage cavity, the first filling channel and the second filling channel are respectively communicated with the first storage cavity and the second storage cavity, and are respectively covered by the two filling caps, each filling cap is provided with a first one-way valve that is unidirectionally communicated from the outside of the storage cavity to the inside of the storage cavity, the filling cap is screwed into a corresponding one of the first filling channel and the second filling channel along a screw-in circumferential direction, the filling caps each has a filling cap connecting portion which is in the shape of a hook that opens in the screw-in circumferential direction, a wall defining the corresponding one of the first filing channel and the second filling channel is provided with a pipeline module connection portion which is in the shape of a hook that opens in opposite direction of the screw-in circumferential direction, the filling cap connecting portion has a protrusion, and the pipeline module connecting portion has a recess, the filling cap connection portion and the pipeline module connection portion are hooked to each other with the protrusion inserted into the recess.

18. The detergent dispensing device as claimed in claim 1, wherein an outer side of the first half shell opposite to the second half shell is provided with a first detergent guiding groove to which the other end of the first outlet channel is opened and a second detergent guiding groove to which the other end of the second outlet channel is opened.

19. The detergent dispensing device as claimed in claim 1, wherein the opening at the other end of the first outlet channel and the opening at the other end of the second outlet channel are arranged on the outer side of the first half shell opposite to the second half shell, and both the opening at the other end of the first outlet channel and the opening at the other end of the second outlet channel are provided with a second one-way valve.

20. A dishwasher including:

a main body with an opening;

a door closing the opening and having an inner plate and an outer plate; and a detergent dispensing device, including:

a storage box including a first half shell and a second half shell fixedly connected to each other in a first direction to define a storage cavity for storing detergent, the storage box including a first storage cavity for storing a first detergent and a second storage cavity for storing a second detergent;

a discharge pump configured to suck the first detergent from the first storage cavity and to dispense the first detergent to the outside of the detergent dispensing device, and to suck the second detergent from the second storage cavity and to dispense the second detergent to the outside of the detergent dispensing device; and a pipeline module including a first inlet channel for extracting the first detergent from the first storage cavity by the discharge pump, a second inlet channel for extracting the second detergent from the second storage cavity by the discharge pump, a first outlet channel for dispensing the first detergent by the discharge pump, and a second outlet channel for dispensing the second detergent by the discharge pump, wherein the second half shell defines a pump accommodating space for accommodating at least a part of the discharge pump, both ends of the pump accommodating space of the second half shell in the first direction have a first opening close to the first half shell and a second opening away from the first half shell to allows the discharge pump to protrude from the first opening and the second opening, the detergent dispensing device is mounted to the door such that at least a part of the second half shell is disposed between the inner plate and the outer plate.

* * * * *